US011926398B1

(12) United States Patent
Downs, Jr.

(10) Patent No.: US 11,926,398 B1
(45) Date of Patent: Mar. 12, 2024

(54) DIVING HELMET APPARATUS

(71) Applicant: United States of America as represented by the Secretary of the Navy, Arlington, VA (US)

(72) Inventor: Edward Downs, Jr., Lynn Haven, FL (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 240 days.

(21) Appl. No.: 16/425,519

(22) Filed: May 29, 2019

(51) Int. Cl.

| | |
|---|---|
| ***B63C 11/06*** | (2006.01) |
| ***A42B 3/18*** | (2006.01) |
| ***A42B 7/00*** | (2006.01) |
| ***B63C 11/12*** | (2006.01) |
| ***B63C 11/14*** | (2006.01) |

(52) U.S. Cl.
CPC ..... *B63C 11/06* (2013.01); *A42B 3/18* (2013.01); *A42B 7/00* (2013.01); *B63C 11/12* (2013.01); *B63C 11/14* (2013.01); *B63C 2011/128* (2013.01)

(58) Field of Classification Search
CPC ..... B63C 11/02; B63C 11/06
USPC ..... 405/186, 187; 128/201.27
See application file for complete search history.

(56) References Cited

U.S. PATENT DOCUMENTS

| | | | | | |
|---|---|---|---|---|---|
| 3,624,663 | A * | 11/1971 | Jones | B63C 11/12 | 2/424 |
| 3,672,365 | A * | 6/1972 | Morgan | B63C 11/02 | 128/201.27 |
| 3,675,650 | A * | 7/1972 | Domyan | B63C 11/02 | 128/201.27 |
| 3,680,556 | A * | 8/1972 | Morgan | B63C 11/06 | 128/201.15 |
| 3,943,571 | A * | 3/1976 | Boatman | B63C 11/06 | 2/421 |
| 3,958,275 | A * | 5/1976 | Morgan | B63C 11/06 | 2/421 |
| 3,991,423 | A * | 11/1976 | Jones | A42B 3/0473 | 2/415 |

(Continued)

FOREIGN PATENT DOCUMENTS

| | | | | |
|---|---|---|---|---|
| FR | 2477892 | A1 * | 9/1981 | B63C 11/06 |
| FR | 2779657 | A1 * | 12/1999 | B63C 11/14 |

(Continued)

*Primary Examiner* — Frederick L Lagman
(74) *Attorney, Agent, or Firm* — James T. Shepherd

(57) ABSTRACT

A diving helmet apparatus includes a diving helmet that is based on a 98$^{th}$ percentile anthropomorphic head form. The helmet is relatively smaller and lighter than convention diving helmets. The center-of-gravity and center-of-buoyancy of the helmet are co-located to reduce diver fatigue. The apparatus has unique neck dam latch devices that use cam mechanisms. The neck dam and the opening in the helmet that receives the diver's head both have a substantially oval shape that contributes to a significant reduction in the volume of the helmet. The apparatus also uses unique face mask latch devices. The neck dam and face mask latch devices allow a diver to easily secure and remove the helmet and face mask without the assistance of dive tenders.

12 Claims, 24 Drawing Sheets

(56) References Cited

U.S. PATENT DOCUMENTS

| | | | | | |
|---|---|---|---|---|---|
| 4,211,220 | A * | 7/1980 | O'Neill | B63C 11/14 | 128/201.27 |
| 4,250,877 | A * | 2/1981 | Owens | A62B 18/04 | 128/201.23 |
| 5,040,528 | A * | 8/1991 | O'Neill | A62B 18/04 | 128/201.27 |
| 5,044,017 | A * | 9/1991 | Kirby | B63C 11/06 | 2/421 |
| 5,219,368 | A * | 6/1993 | Page | A42B 3/08 | 128/201.24 |
| 6,138,283 | A * | 10/2000 | Kress | A42B 3/328 | 2/411 |
| 2006/0118109 | A1* | 6/2006 | Sato | B63C 11/14 | 128/201.27 |
| 2007/0051365 | A1* | 3/2007 | Diaz | B63C 11/06 | 128/201.27 |
| 2009/0050147 | A1* | 2/2009 | Ginn | B63C 11/02 | 128/201.27 |
| 2015/0284061 | A1* | 10/2015 | Anderson | B63C 11/02 | 405/186 |
| 2016/0083058 | A1* | 3/2016 | Maki | B63C 11/186 | 128/201.11 |

FOREIGN PATENT DOCUMENTS

| | | | | |
|---|---|---|---|---|
| GB | 1390348 | A * | 4/1975 | B63C 11/06 |
| JP | 04046888 | A * | 2/1992 | B63C 11/06 |
| WO | WO-2015075567 | A1 * | 5/2015 | B63C 11/02 |

* cited by examiner

DIVING HELMET APPARATUS

STATEMENT OF GOVERNMENT INTEREST

The invention described herein may be manufactured and used by or for the Government of the United States of America for governmental purposes without the payment of any royalties thereon or therefor.

FIELD OF THE INVENTION

The present invention relates to a helmet apparatus.

BACKGROUND

Conventional diving helmets are typically tethered to an air hose that supplies breathing gas for the diver. Such a diving helmet contains large amounts of lead so the helmet is negatively buoyant when submerged. The lead also keeps the helmet on the diver. Conventional diving helmets are typically configured to use a large circular neck dam ring that is sized to fit over the head of any diver. However, diving helmets that use large circular neck dam rings are large, heavy and bulky. For example, such large circular neck dam rings result in a 15%-20% increase in the size of the diving helmet. Furthermore, the helmet walls of such conventional helmets are made of thick fiberglass so the helmet will be robust. As a result, the helmet is so large and heavy that it must be placed upon the diver's head by two assistants called dive tenders. Conventional tethered diving helmets are secured to the diver's neck dam using two cylindrical pins roughly ⅜" in diameter. The cylindrical pins are inserted into locking rings located on the left and right side of the helmet to secure the helmet to the diver's neck dam. A disadvantage of this configuration is that the clearance between the cylindrical pins and the locking cylinders is so small that a small amount of sand or other foreign particle can prevent insertion of the cylindrical pin into the locking rings. Furthermore, in many conventional diving helmets, the center-of-buoyancy (CB) and center-of-gravity (CG) are offset thereby creating a force moment by the opposite acting forces. As a result, the diver must use his neck muscles to keep the helmet positioned thereby resulting in the diver becoming fatigued and even possibly injured.

What is needed is a new and improved diving helmet apparatus that eliminates the aforementioned disadvantages and problems of conventional diving helmets.

SUMMARY OF THE INVENTION

In some embodiments, the present invention is directed to a diving helmet apparatus that comprises a helmet that has a significantly reduced weight and volume in comparison to conventional helmets. The helmet allows the diver to easily engage in free swimming and can be used with open circuit or closed circuit rebreathers. The helmet can be donned and doffed by a diver without the need for dive tenders. The center of gravity (CG) and center of buoyance (CB) are located in or near the geometric center of the helmet thereby allowing the diver to easily swim. A feature of the helmet is that its form, shape, size and volume are based on a $98^{th}$ percentile anthropomorphic head form. Such features and characteristics allow the helmet to be as light as possible with reduced volume.

In some embodiments, the present invention is directed to a helmet comprising an exterior surface, an interior region for a user's head, an interior wall within the interior region, a substantially oval-shaped head-entry opening leading to the interior region and a substantially oval-shaped neck dam mating surface extending about the substantially oval-shaped head-entry opening. The helmet has a shape, size and volume based on a $98^{th}$ percentile anthropomorphic head form.

In some embodiments, the present invention is directed to a helmet apparatus comprising a helmet that has an exterior surface, an interior region for a user's head and an interior wall extending about the interior region. The helmet apparatus further comprises a substantially oval-shaped head-entry opening leading to the interior region and a substantially oval-shaped neck dam mating surface extending about the substantially oval-shaped head-entry opening. The helmet has a shape, size and volume based on a $98^{th}$ percentile anthropomorphic head form. The helmet further comprises a pair of neck dam latch pins. One of the neck dam latch pins is attached to the exterior surface of the helmet and located on a first side of the helmet and the other neck dam latch pin is attached to the exterior surface of the helmet and located on an opposite second side of the helmet. The helmet apparatus further comprises a neck dam comprising a neck dam frame having a substantially oval shape that corresponds to the substantially oval shape of the neck dam mating surface. The neck dam frame has a surface adapted to be joined to the substantially oval-shaped mating surface of the helmet. The helmet apparatus further comprises a pair of neck dam latch devices attached to the neck dam frame. Each neck dam latch device is associated with a corresponding one of the pair of neck dam latch pins and is configurable to a first position to engage the neck dam latch pin so as to secure the neck dam mating surface of the helmet to the surface of the neck dam frame and to a second position to disengage the neck dam latch pin so as to release the neck dam mating surface from the surface of the neck dam frame.

Although the description herein is primarily directed to a helmet apparatus for use in underwater activities, it is to be understood that the apparatus of the present invention may be used in other applications as well, including sports, space exploration, hazardous and radio-active waste removal, fire-fighting, underground mining, and industrial processes requiring exposure to chemicals, solvents and gases, without departing from the scope of the claimed invention.

Certain features and advantages of the present invention have been generally described in this summary section. However, additional features, advantages and embodiments are presented herein or will be apparent to one of ordinary skill of the art in view of the drawings, specification and claims hereof. Accordingly, it should be understood that the scope of the invention shall not be limited by the particular embodiments disclosed in this summary section.

DESCRIPTION OF EXEMPLARY EMBODIMENTS OF THE INVENTION

As used herein, the terms "comprises", "comprising", "includes", "including", "has", "having" or any other variation thereof, are intended to cover a non-exclusive inclusion. For example, a process, method, article or apparatus that comprises a list of elements is not necessarily limited to only those elements, but may include other elements not expressly listed or inherent to such process, method, article or apparatus.

It is to be understood that throughout this description, terms such as "vertical", "horizontal", "top", "bottom", "upper", "lower", "middle", "above", "below" and the like are used for convenience in identifying relative locations of various components and surfaces relative to one another in reference to the drawings and that the apparatus of the present invention may be installed and used in substantially any orientation so that these terms are not intended to be limiting in any way.

Approximating language, as used herein throughout the specification and claims, may be applied to modify any quantitative representation that could permissibly vary without resulting in a change in the basic function to which it is related. Accordingly, a value modified by a term such as "about" or "approximately" is not limited to the precise value specified.

Figure 1A:
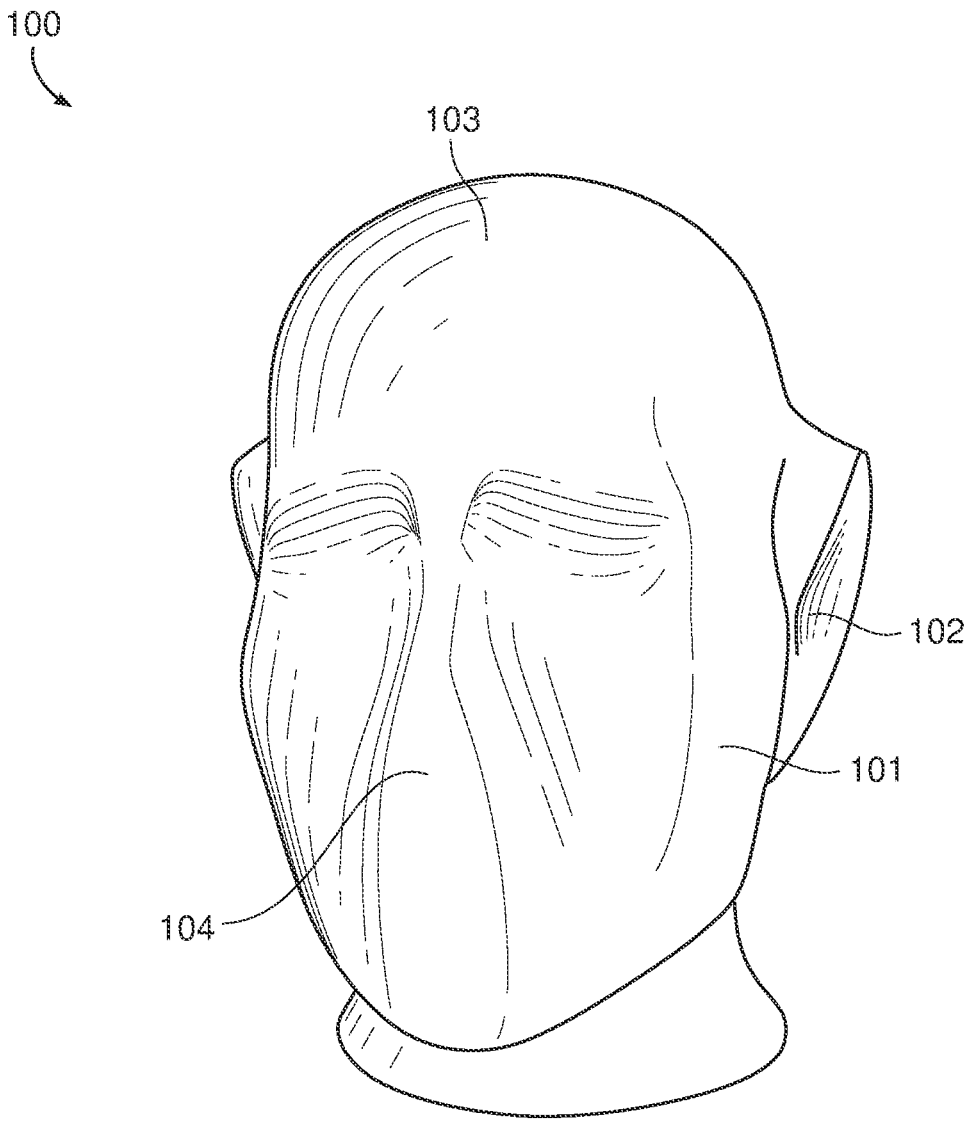
FIG. 1A is a perspective view of a $98^{th}$ percentile anthropomorphic head form upon which the diving helmet apparatus of the present invention is based.
Figure 1B:
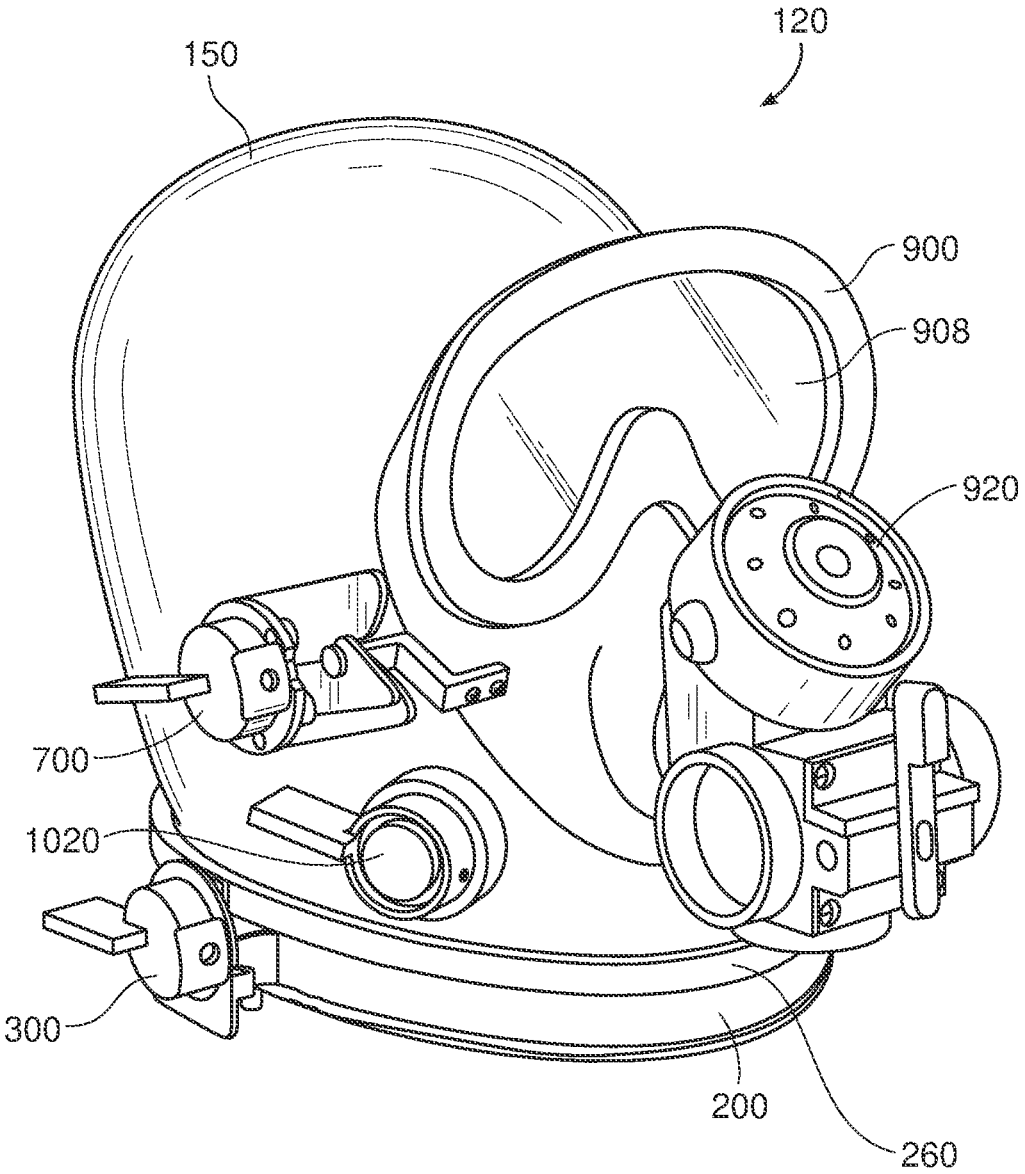
FIG. 1B is a side view, in perspective, of the diving helmet apparatus of the present invention.

The diving helmet apparatus of the present invention comprises a diving helmet that is configured to have the smallest size possible that would fit 98% of the heads of the human male population. Thus, the diving helmet is just large enough for a diver's head, ears, mouth, chin and cheeks to fit into the helmet with a small amount of room left for comfort pads. In order to provide such a diving helmet, a significantly large group of pilots was used to compile data that was used to create a $98^{th}$ percentile anthropomorphic head form. Specifically, the head of each pilot was scanned with a laser scanner. All the data from the laser scanning was compiled and used to create the $98^{th}$ percentile anthropomorphic head form. The laser scanning provided accurate measurements of the human male head, nose, chin, cheeks and ears. Referring to FIG. 1A, there is shown a perspective view of the resulting $98^{th}$ percentile anthropomorphic head form 100 that is based on the compilation of the data generated by scanning the heads of the pilots. Head form 100 comprises the $98^{th}$ percentile cheek, indicated by reference number 101, and the $98^{th}$ percentile ear, indicated by reference number 102. The anthropomorphic head form 100 further comprises the $98^{th}$ percentile head, indicated by reference number 103, and the $98^{th}$ percentile nose, mouth and chin, all which being indicated by reference number 104. Referring to FIG. 1B, there is shown diving helmet apparatus 120 of the present invention which is based on the $98^{th}$ percentile anthropomorphic head form 100.

Diving helmet apparatus 120 comprises helmet 150. Helmet 150 includes a head-entry opening through which the diver inserts his or her head. The head-entry opening has a substantially oval shape. Helmet 150 is configured such that the center-of-gravity (CG) and center-of-buoyancy (CB) of the helmet are co-located, preferably in the geometric center of helmet 150. As a result, helmet 150 is light enough so that it can be worn by a free-swimming diver without offsetting forces of the CG and CB creating a force moment that the diver must counteract with the neck muscles. Determining the CG and CB can be accomplished by any design method known in the art, such as known computer modelling methods. It can also be accomplished iteratively by real life measurements (e.g., in a water tank) while adding/moving one or more lead sheets at various locations on the exterior surface of the helmet until the CG and CB coincide with the geographic center of the interior of the helmet. In one example, a 0.125 inch thick lead sheet was used to iteratively shift the CG to a desired location. Once the process was complete, the lead sheet was sealed inside the helmet by covering it and the rest of the helmet with a uniform layer with fiberglass, being careful to minimize the effects that the addition of the fiberglass has on the CG and CB.

Figure 2A:
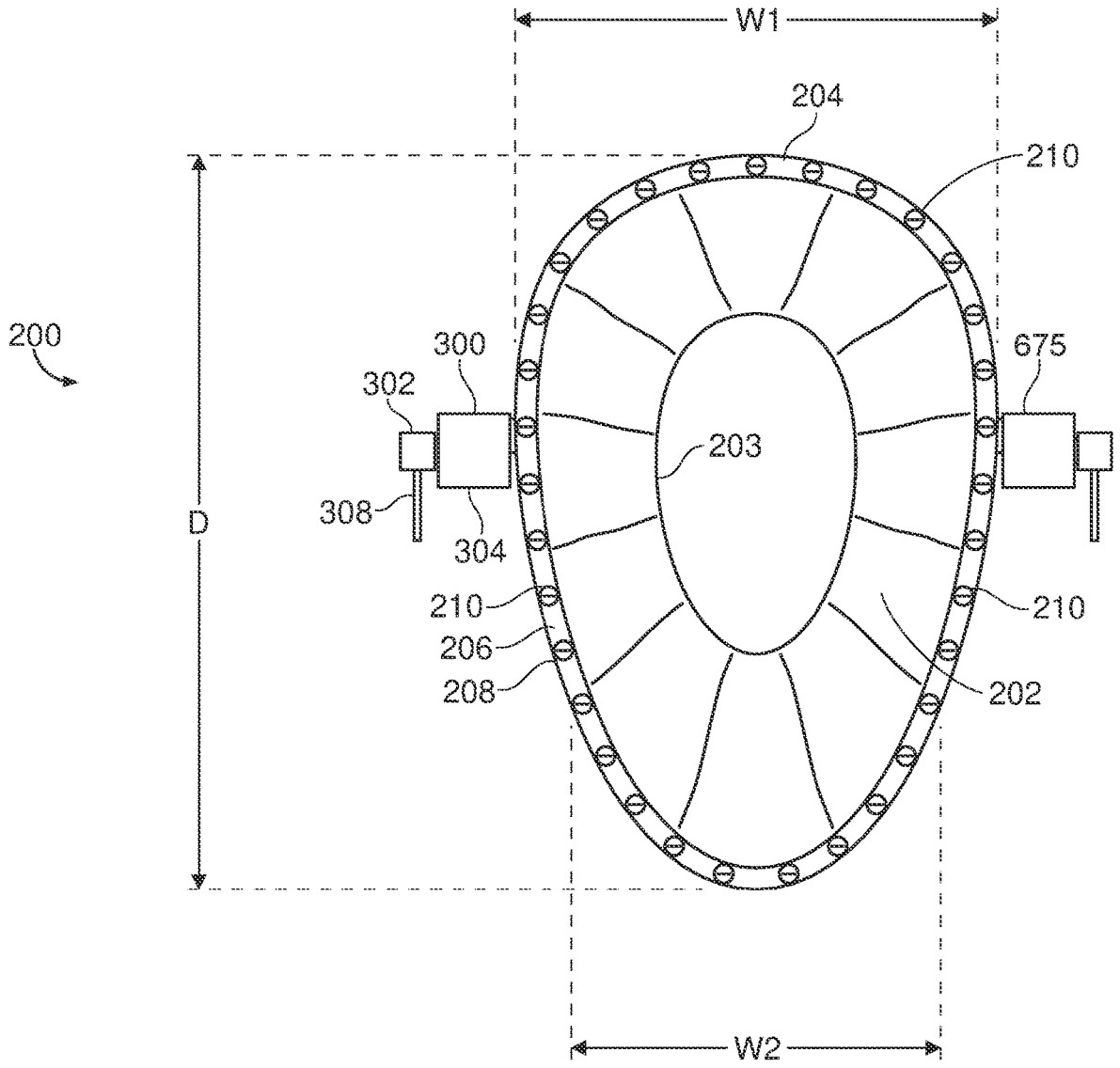
FIG. 2A is a top plan view of a neck dam of the diving helmet apparatus.

Referring to FIG. 2A, diving helmet apparatus 120 further includes neck dam 200 (location shown in FIG. 1B). The function of neck dam 200 is to prevent water from entering helmet 150. Neck dam 200 has a substantially oval shape which matches the substantially oval shape of the head-entry opening of helmet 150. The substantially oval shape of the head-entry opening of helmet 150 and the substantially oval shape of neck dam 200 significantly reduces the volume and weight of helmet 150. Neck dam 200 comprises sleeve 202 which has opening 203 sized to receive a diver's head. Neck dam 200 further comprises frame 204 which retains sleeve 202 in place. In an exemplary embodiment, sleeve 202 is a pliable, tapered neoprene sleeve. Sleeve 202 fits snugly around and against the diver's neck thereby preventing water from entering the helmet. In an exemplary embodiment, frame 204 is substantially flat and includes top surface 206 and perimetrical side or edge 208. In an exemplary embodiment, frame 204 is fabricated from a corrosion-resistant metal such as stainless steel. The outer portion of sleeve 202 is secured to frame 204 using flush mounted screws 210. In an exemplary embodiment, flush mounted screws 210 are fabricated from stainless steel. Sleeve 202 can be removed so that frame 204 can be attached to a diver's dry suit. As shown in FIG. 2A, in an exemplary embodiment, neck dam 200 has a depth D of about 10.5 inches, a first width W1 of about 8.5 inches and a second width W2 of about 7.25 inches.

Neck dam 200 is fitted over the diver's head before the diver dons helmet 150. As described above, sleeve 202 fits snugly around and against the diver's neck thereby preventing water from entering helmet 150. When in use, helmet 150 is firmly secured to neck dam 200 so helmet 150 cannot be inadvertently dislodged from neck dam frame 204. As shown in FIG. 2A, neck dam latch devices 300 and 675 are attached to perimetrical edge or side 208 of frame 204 and are configured to latch onto corresponding neck dam latch pins 250 and 252 that are attached to lower portion 260 of helmet 150 (see FIG. 2B). Lower portion 260 extends about the substantially oval-shaped head entry opening of helmet 150 which was described in the foregoing description.

Figure 2B:
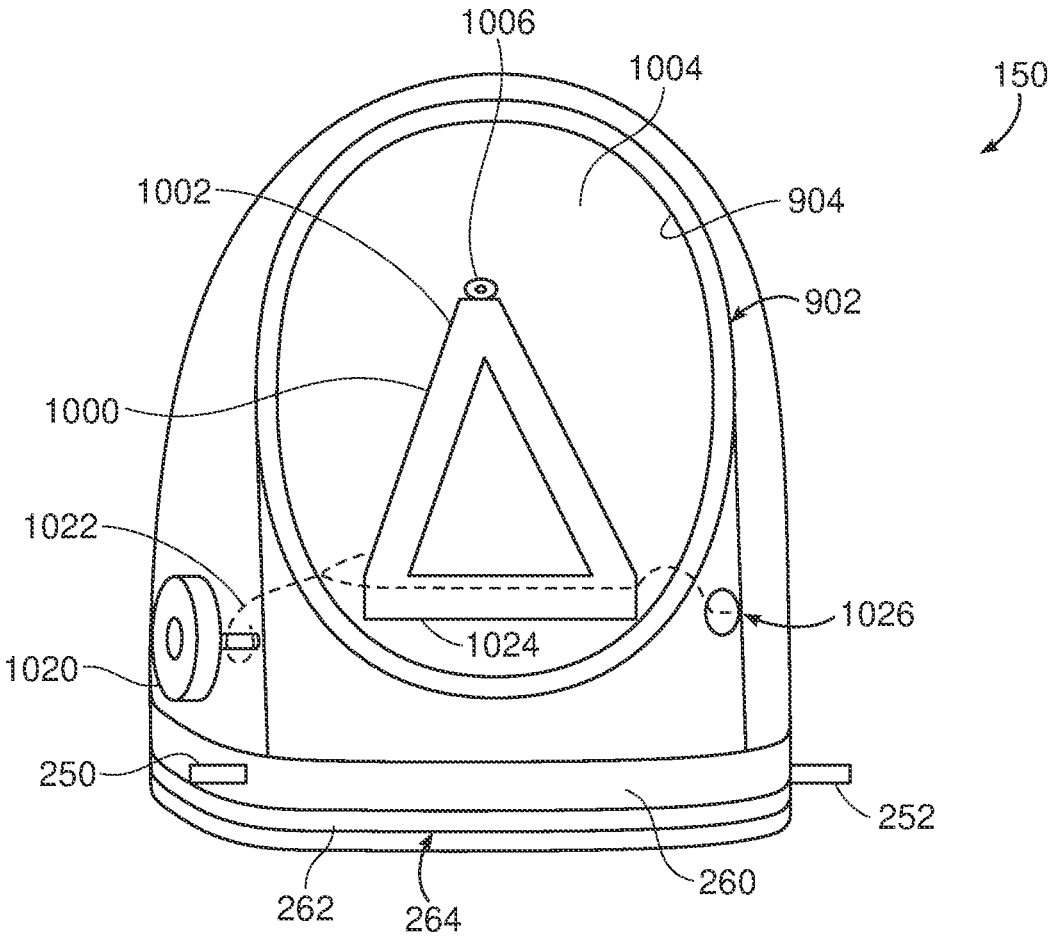
FIG. 2B is a front view, in perspective, of the diving helmet shown in FIG. 1B, the face mask not being shown so as to facilitate viewing of the interior region of the diving helmet.

Referring to FIG. 2B, there is shown a front, perspective view of helmet 150. Helmet 150 includes neck dam mating ring 262 that has the same shape as neck dam frame 204. In order to create a water-tight seal between neck dam frame 204 and neck dam mating ring 262, helmet 150 includes ring seal 264 that is attached to neck dam mating ring 262. In an exemplary embodiment, seal 264 is a polymer seal. Any suitable technique may be used to attach seal 264 to neck dam mating ring 262. In an exemplary embodiment, an adhesive is used to attach seal 264 to neck dam mating ring 262.

Neck dam latch devices 300 and 675 perform two functions. First, when it is desired to attach helmet 150 to neck dam 200, the diver configures neck dam latch devices 300 and 675 to the locked state wherein neck dam latch devices 300 and 675 grasp and firmly retain neck dam latch pins 250 and 252, respectively. As the diver is configuring neck dam latch devices 300 and 675 to the locked state, helmet 150 is pulled downward upon neck dam frame 204 such that ring seal 264 forms a water-tight seal with top surface 206 of neck dam frame 204. Second, when it is desired to separate helmet 150 from neck dam frame 204, the diver configures neck dam latches 300 and 675 to the unlocked state in order to release neck dam latch pins 250 and 252. As neck dam latch devices 300 and 675 are being configured to the unlocked state, the neck dam latch devices 300 and 675 function as mechanical levers that pry helmet 150 off of neck dam frame 204 thereby breaking the water-tight seal formed by neck dam frame 204 and ring seal 264. The particular structure of each neck dam latch device 300 and 675 allows the diver to easily overcome the force needed to pry helmet 150 off of neck dame frame 204.

Figure 3:
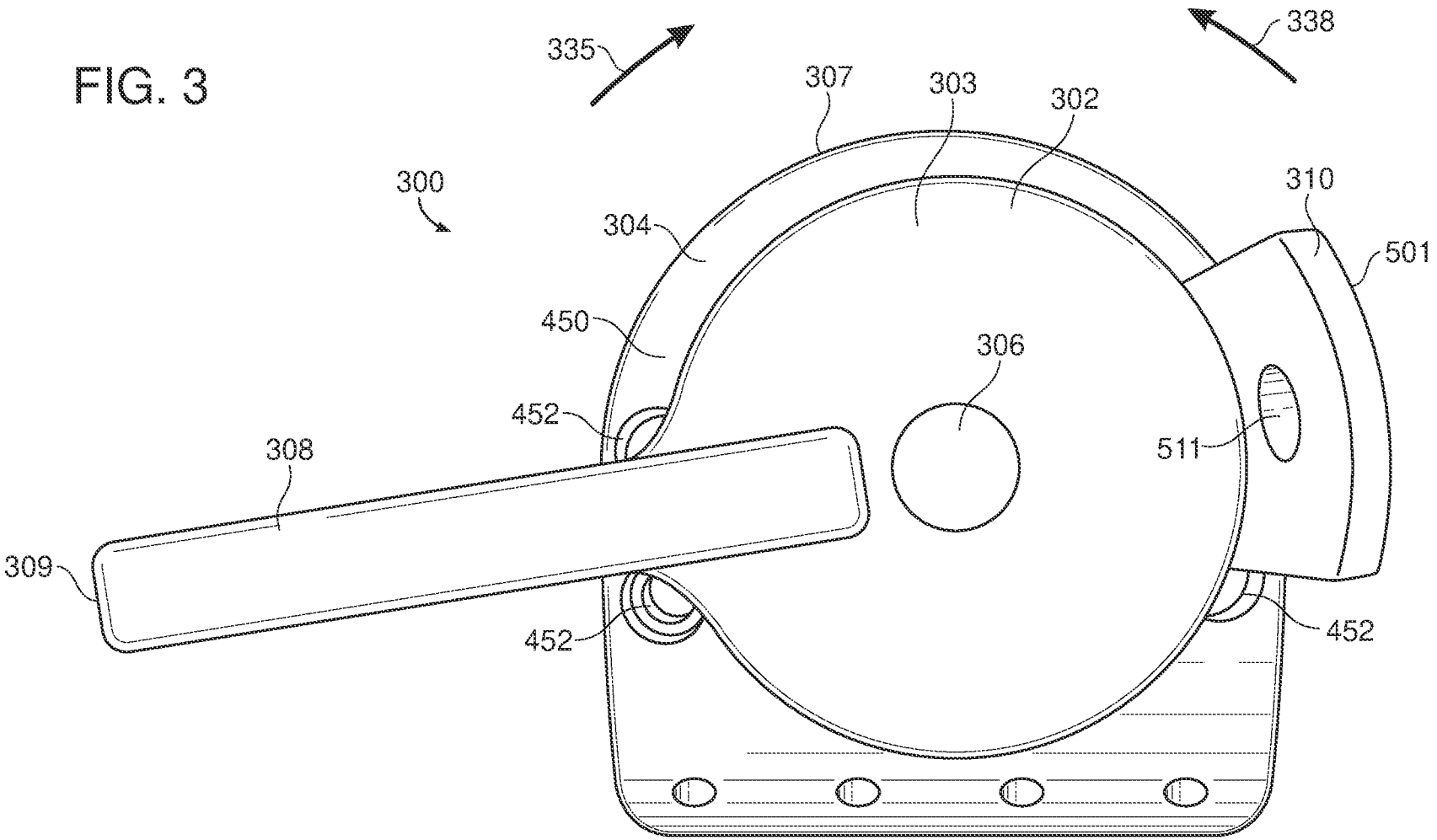
FIG. 3 is a perspective view of the front side of a neck dam latch device shown in FIG. 1B.
Figure 4:
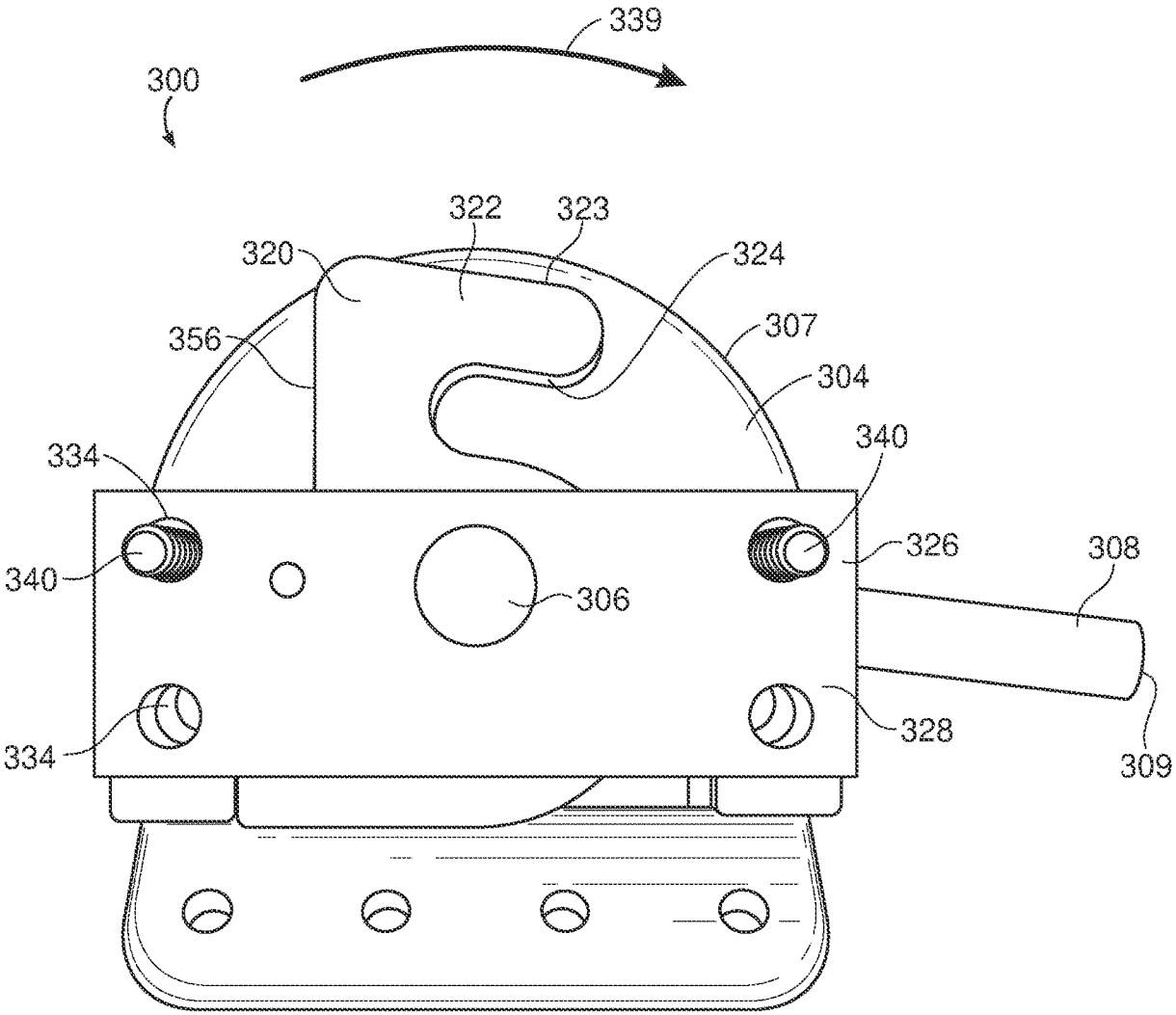
FIG. 4 is a perspective view of the rear side of the neck dam latch device, wherein the neck dam latch is configured to secure the helmet to the neck dam.
Figure 5:
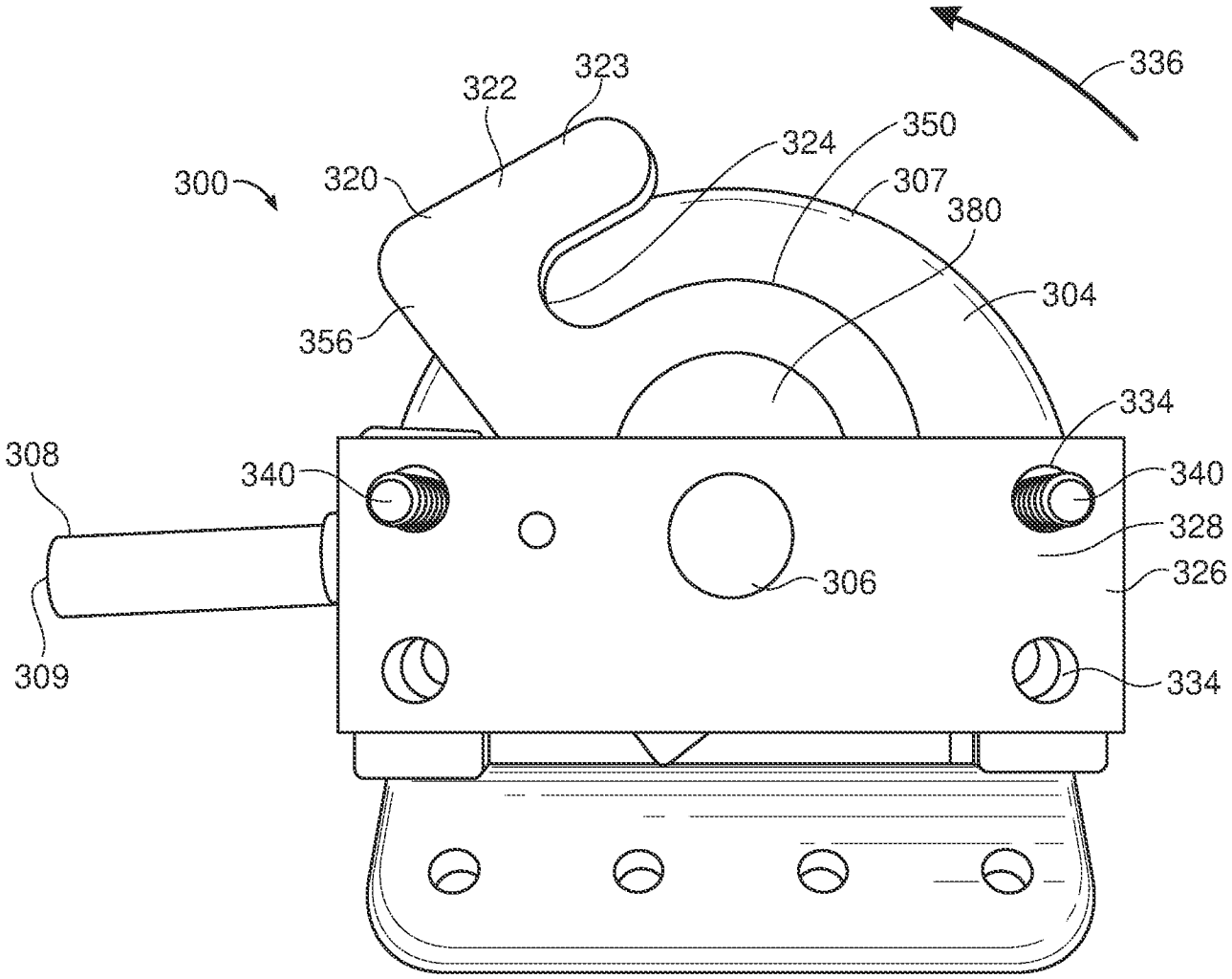
FIG. 5 is a perspective view of the rear side of the neck dam latch device, wherein the neck dam latch device is configured to release the helmet from the neck dam.
Figure 6:
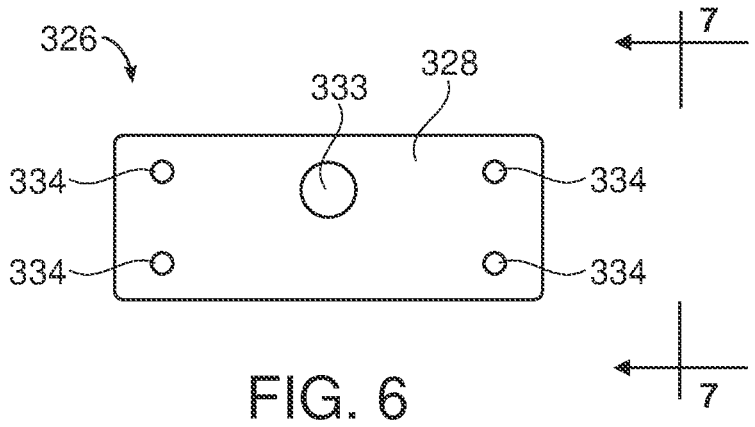
FIG. 6 is a front view of a cam latch support plate shown in FIGS. 4 and 5.
Figure 7:
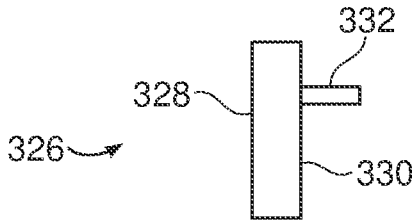
FIG. 7 is side view of the cam latch support plate.

Referring to FIGS. 3-13, there is shown neck dam latch device 300 in accordance with an exemplary embodiment of the invention. Since neck dam latch device 300 and neck dam latch device 675 have identical structures and components, only neck dam latch device 300 is discussed in detail. Neck dam latch device 300 comprises neck dam latch casing 302 which has exterior surface 303. Neck dam latch device 300 further includes neck dam latch body 304. Latch body 304 includes rotatable neck dam latch shaft member 306. Shaft member 306 is rotatably attached to latch body 304. Latch casing 302 is attached to shaft member 306 such that latch casing 302 rotates with respect to latch body 304. Shaft member 306 is attached to a cam mechanism that is located on the rear side of latch body 304 and which is described in detail in the ensuing description. Latch body 304 includes perimetrical edge 307. Latch handle 308 is attached to latch casing 302 and allows the diver to rotate latch casing 302 with respect to latch body 304 either in the clockwise direction or counter-clockwise direction. Latch handle 308 has end portion 309. As will be explained in detail in the ensuing description, latch body 304 is attached to outer perimetrical edge or side 208 of neck dam frame 204 as shown in FIG. 2A. Referring to FIGS. 4 and 5, neck dam latch device 300 further comprises neck dam cam latch 320 that rotates with latch casing 302. Cam latch 320 is briefly described here to facilitate understanding of this aspect of the invention but is described in detail in the ensuing description. Cam latch 320 comprises arm member 322. Arm member 322 has upper edge 323 and notch 324. Notch 324 is sized to receive latch pin 250 on lower portion 260 of helmet 150. Referring to FIG. 4, there is shown a rear view of neck dam latch device 300 in the locked position. In order to grasp and retain latch pin 250 so as to pull helmet 150 down on neck dam frame 204, neck dam latch device 300 must be in this locked position shown in FIG. 4. FIG. 5 shows a rear view of neck dam latch device 300 in the unlocked position. In order for cam latch 320 to release latch pin 250, neck dam latch device 300 must be configured to this unlocked position.

Neck dam latch device 300 includes latch release mechanism 310 that allows clockwise or counter-clockwise movement of latch casing 302. Latch release mechanism 310 is not attached to latch casing 302 but does rotate clockwise or counterclockwise with latch casing 302. Latch release mechanism 310 is only briefly described here in order to facilitate understanding of the operation of neck dam latch device 300 but is described in detail in the ensuing description. Latch release mechanism 310 includes arm member 500 (see FIG. 14A). Arm member 500 includes outwardly extending flange member 501. Flange member 501 allows the user (e.g. diver) to configure latch release mechanism 310 so as to allow rotation of latch casing 302. In order to rotate latch casing 302 using handle 308, the diver uses his or her fingers (e.g. thumb and index finger) to grasp flange member 501 and end portion 309 of latch handle 308 and then press flange member 501 inwardly (i.e. radially toward shaft member 306). Arm member 500 includes tab 502 that is sized to fit into front recess or notch 400 of latch body 304 (see FIG. 13). Tab 502 is also sized to fit into rear recess or notch 402 of latch body 304 (see FIG. 12).

Figure 14A:
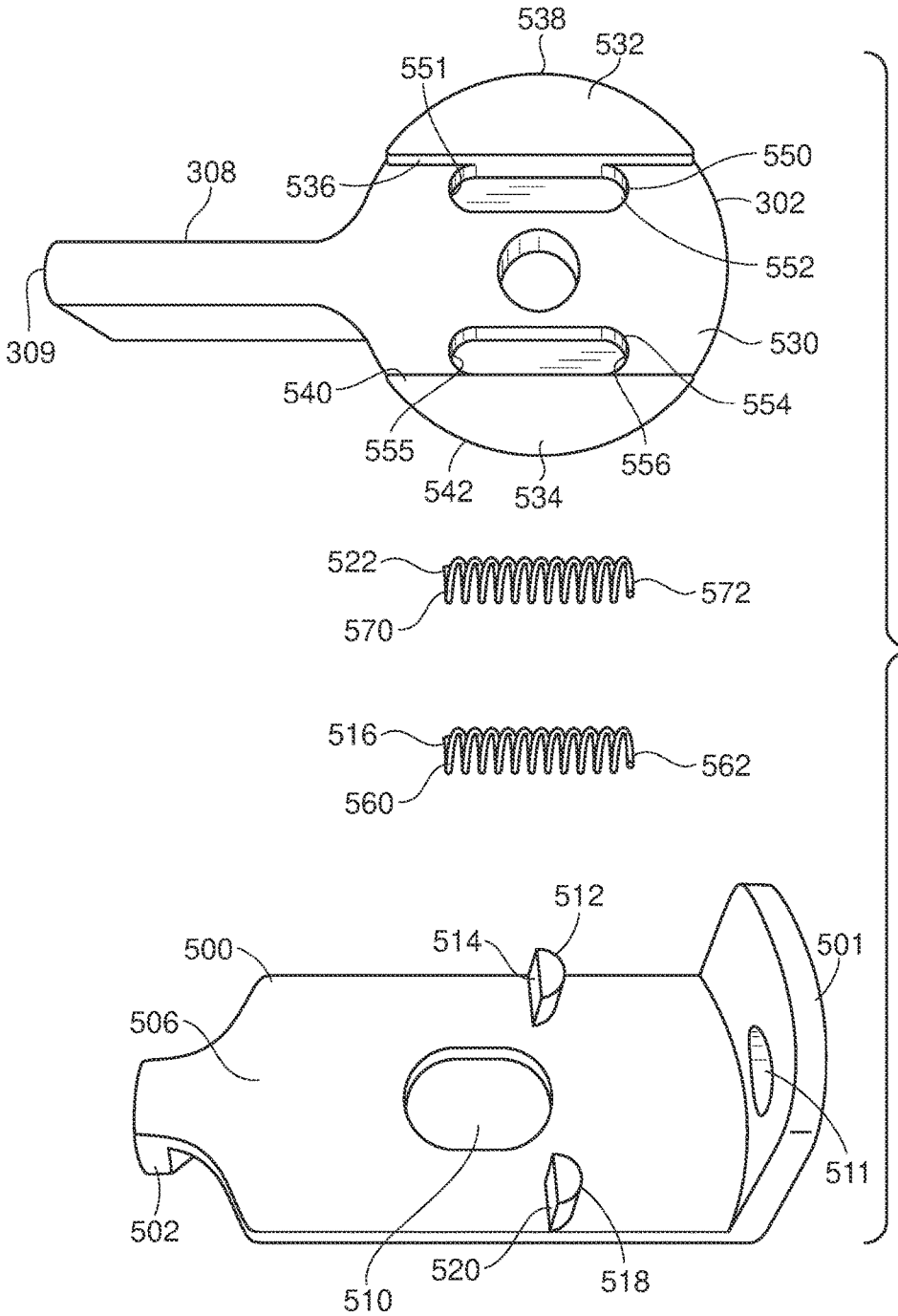
FIG. 14A is an exploded view showing a latch release mechanism of the neck dam latch device.
Figure 15:
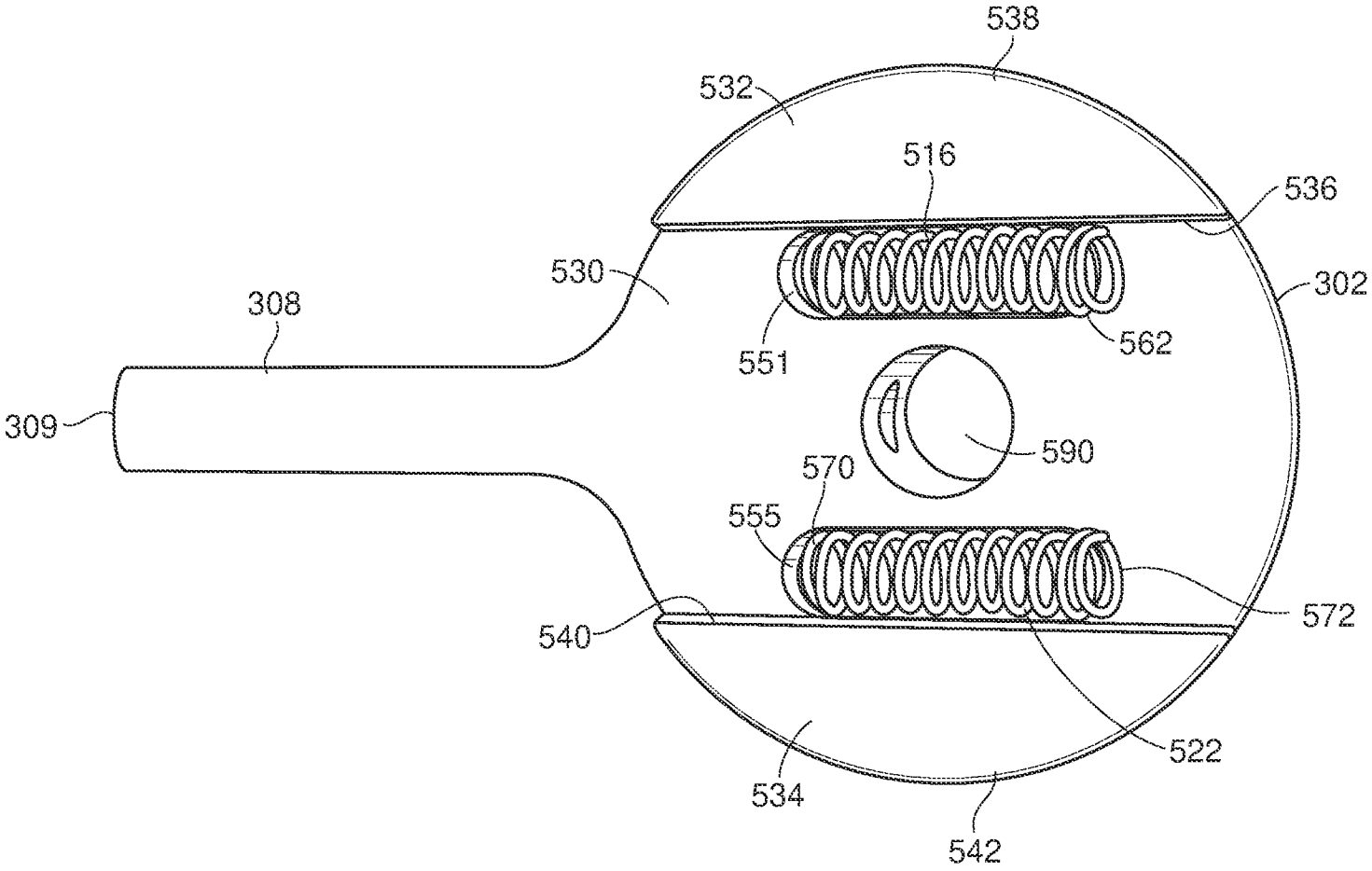
FIG. 15 is a perspective view of the rear side of the latch casing showing spring members are disposed within corresponding channels.

It is to be understood the "clockwise" and "counter-clockwise" rotation are to be interpreted with respect to the front view of neck dam latch device 300, such as the view of FIG. 3. Referring to FIGS. 14A and 15, neck dam latch device 300 further comprises internal spring members 516 and 522 that constantly urge or bias arm member 500 in a direction that is opposite to the radial force applied to flange member 501 by the diver. Referring to FIGS. 3-5, in order to configure neck dam latch device 300 so as to release latch pin 250, the diver grasps end portion 309 of latch handle 308 and flange member 501 and presses flange member 501 inward toward shaft member 306 as described in the foregoing description so that tab 502 is moved out of rear recess 402. While keeping flange member 501 depressed, the diver simultaneously rotates latch casing 302 clockwise as indicated by arrow 335 (see FIG. 3) using latch handle 308. The direction indicated by arrow 335 translates to the direction indicated by arrow 336 in FIG. 5 since the view shown in FIG. 5 is the rear of neck dam latch device 300. Once tab 502 clears rear recess 402, tab 502 rides or slides along perimetrical edge 307 of latch body 304 so it is not necessary for the user to continue to apply any force to flange member 501. As latch casing 302 is rotating clockwise, cam latch 320 is also rotating clockwise in order to release latch pin 250. As cam latch 320 rotates clockwise, upper edge 323 of cam latch 320 presses upward against lower portion 260 of helmet 150 thereby prying or pushing helmet 150 off neck dam 200. The user continues to rotate latch casing 302 until tab 502 slips into front recess 400 as a result of the force created by spring members 516 and 522. Once tab 502 is positioned in front recess 400, neck dam latch device 300 is completely configured in the open or unlocked state and latch pin 250 is free of cam latch 320. Assuming neck dam latch device 700 is also configured in the open or unlocked state, the user can then remove helmet 150 from neck dam 200. In order to lock helmet 150 to neck dam 200, the diver positions helmet 150 on neck dam 200 such that ring seal 264 contacts neck dam frame 204. The diver then depresses flange member 501 as described in the foregoing description so that tab 502 is moved out of front recess 400. Next, the diver uses latch handle 308 to rotate latch casing 302 counter-clockwise in the direction indicated by arrow 338 in FIG. 3 such that tab 502 moves along the perimetrical edge 307 until tab 502 is pulled into rear recess 402. As described in the forgoing description, the force produced by spring members 516 and 522 causes tab 502 to be pulled into rear recess 402 as the counter-clockwise rotation of latch casing 302 comes to an end. As latch casing 302 rotates counter-clockwise, cam latch 320 rotates counter-clockwise (as viewed in FIG. 3) or in the direction of arrow 339 as viewed in FIG. 4. As cam latch 320 rotates, neck dam latch pin 250 enters notch 324 of arm section 322. As cam latch 320 continues to rotate with latch pin 250 in notch 324, cam latch 320 pulls helmet 150 downward such that ring seal 264 firmly contacts neck dam frame 204 to create a water-tight seal. When tab 502 is completely positioned in rear recess 402, latch pin 250 is completely and tightly positioned within notch 324.

Referring to FIGS. 4-7, neck dam latch device 300 further comprises cam latch support plate 326. Cam latch support plate 326 retains cam latch 320 in place and includes exterior side 328, interior side 330 and cam latch pin 332 that extends from interior side 330. Cam latch support plate 326 further includes opening 333 that is sized to receive the end portion of shaft member 306. Cam latch support plate 326 further includes openings or thru-holes 334 for receiving screws or fasteners 340 that extend from latch body 304. Screws 340 are used to attach neck dam latch device 300 to neck dam frame 204. When neck dam latch device 300 is attached to neck dam frame 204, cam latch support plate 326 is located between cam latch 320 and neck dam frame 204 and the exterior side 328 of cam latch support plate 326 abuts neck dam frame 204.

Figure 8:
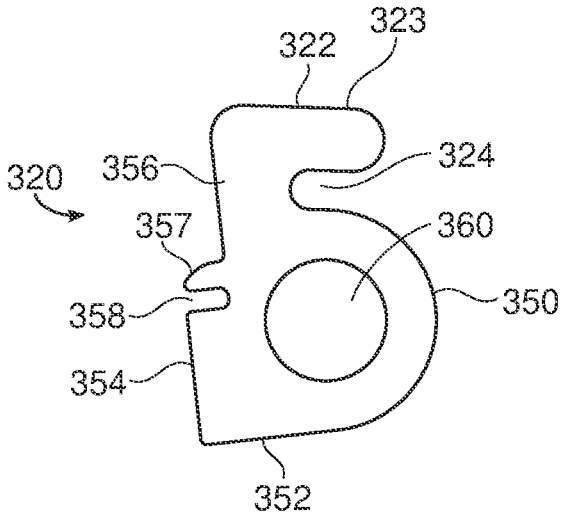
FIG. 8 is a front view of a cam latch shown in FIGS. 4 and 5.
Figure 9:
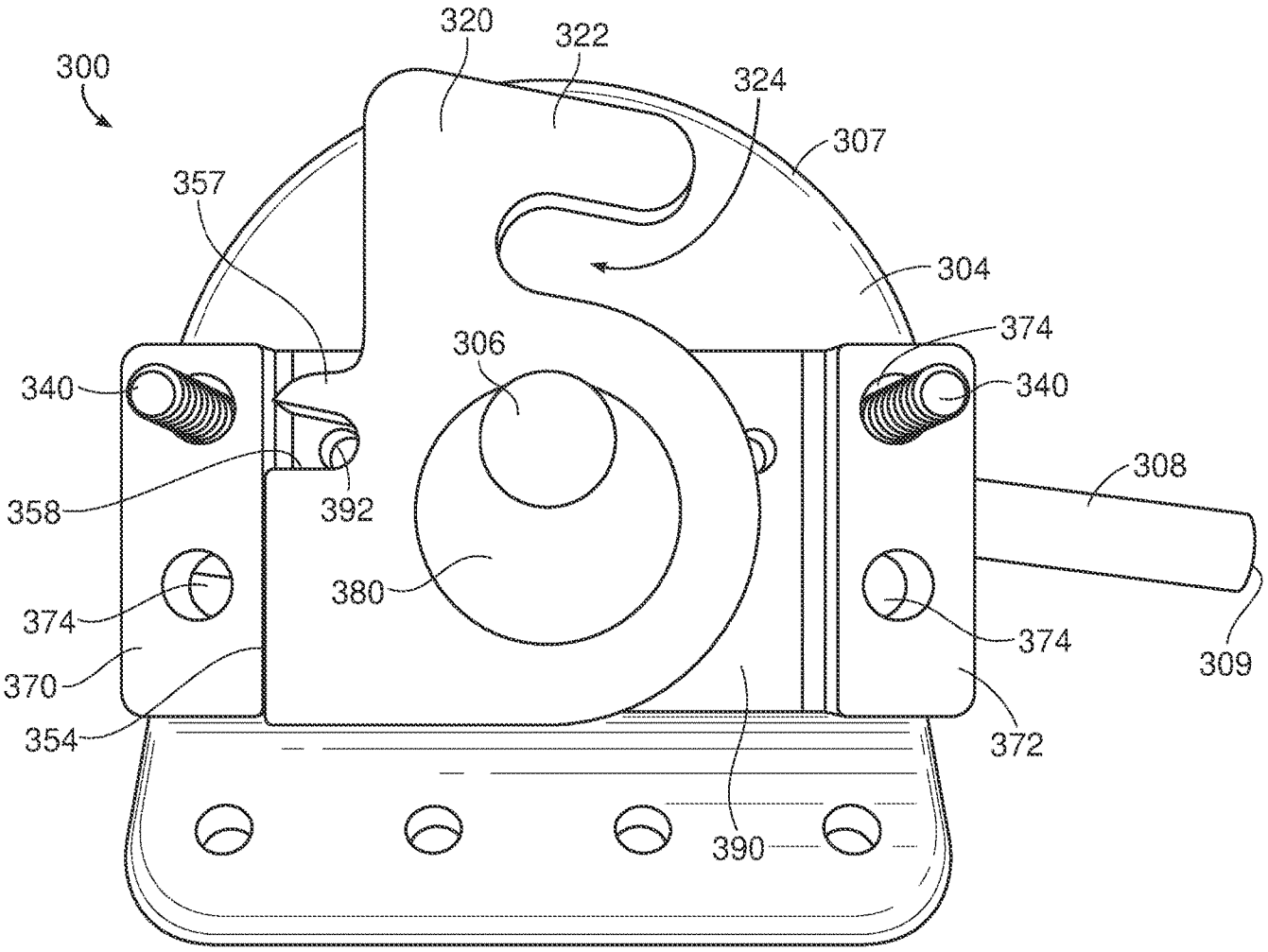
FIG. 9 is a perspective view of the rear side of the neck dam latch device similar to the view of FIG. 4, except the cam latch support plate is not shown in order to facilitate viewing of the cam latch.
Figure 10:
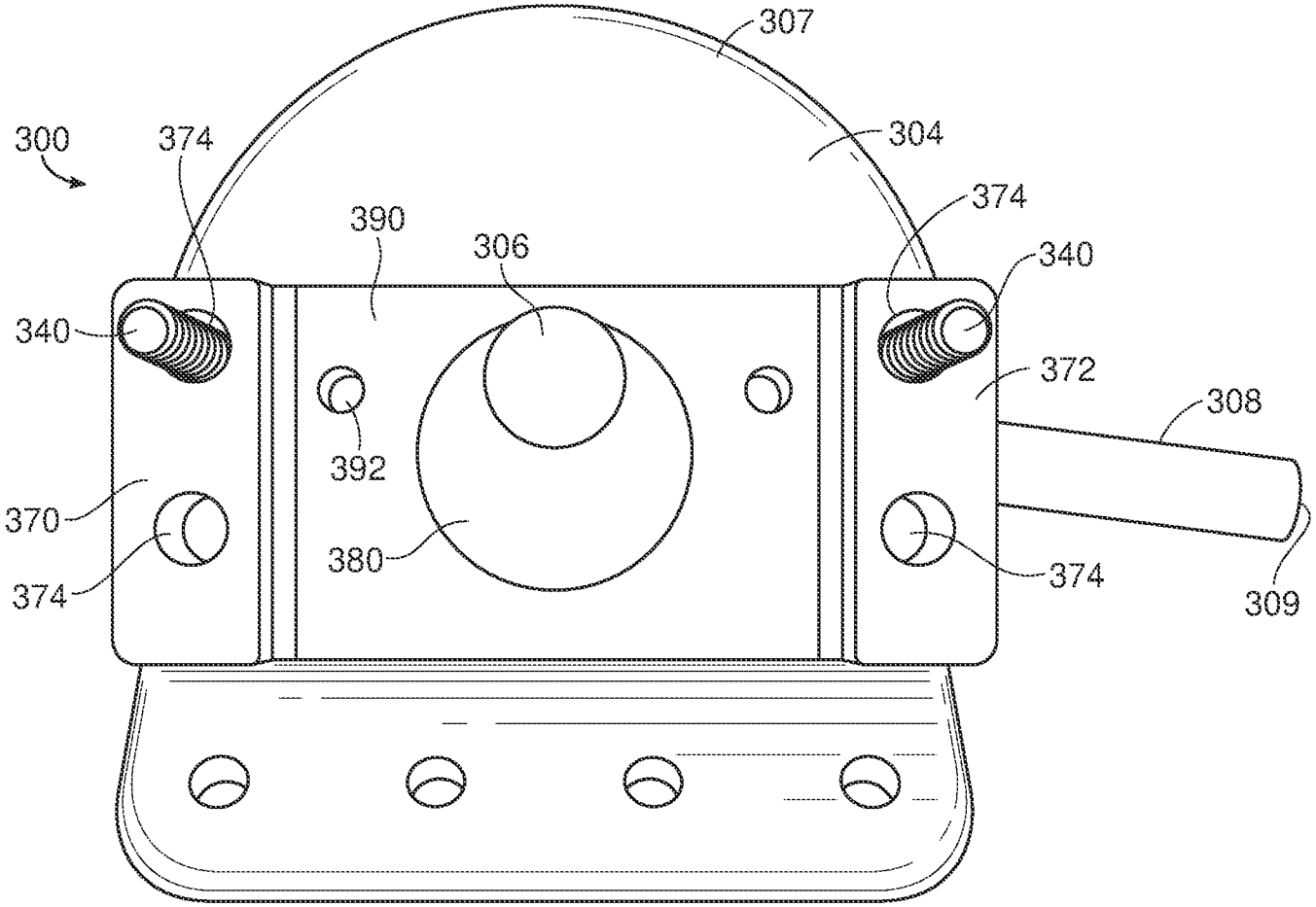
FIG. 10 is a perspective view of the rear side of the neck dam latch similar to the view of FIG. 4, except the cam latch support plate and the cam latch are not shown in order to facilitate viewing of a cam mechanism.
Figure 11:
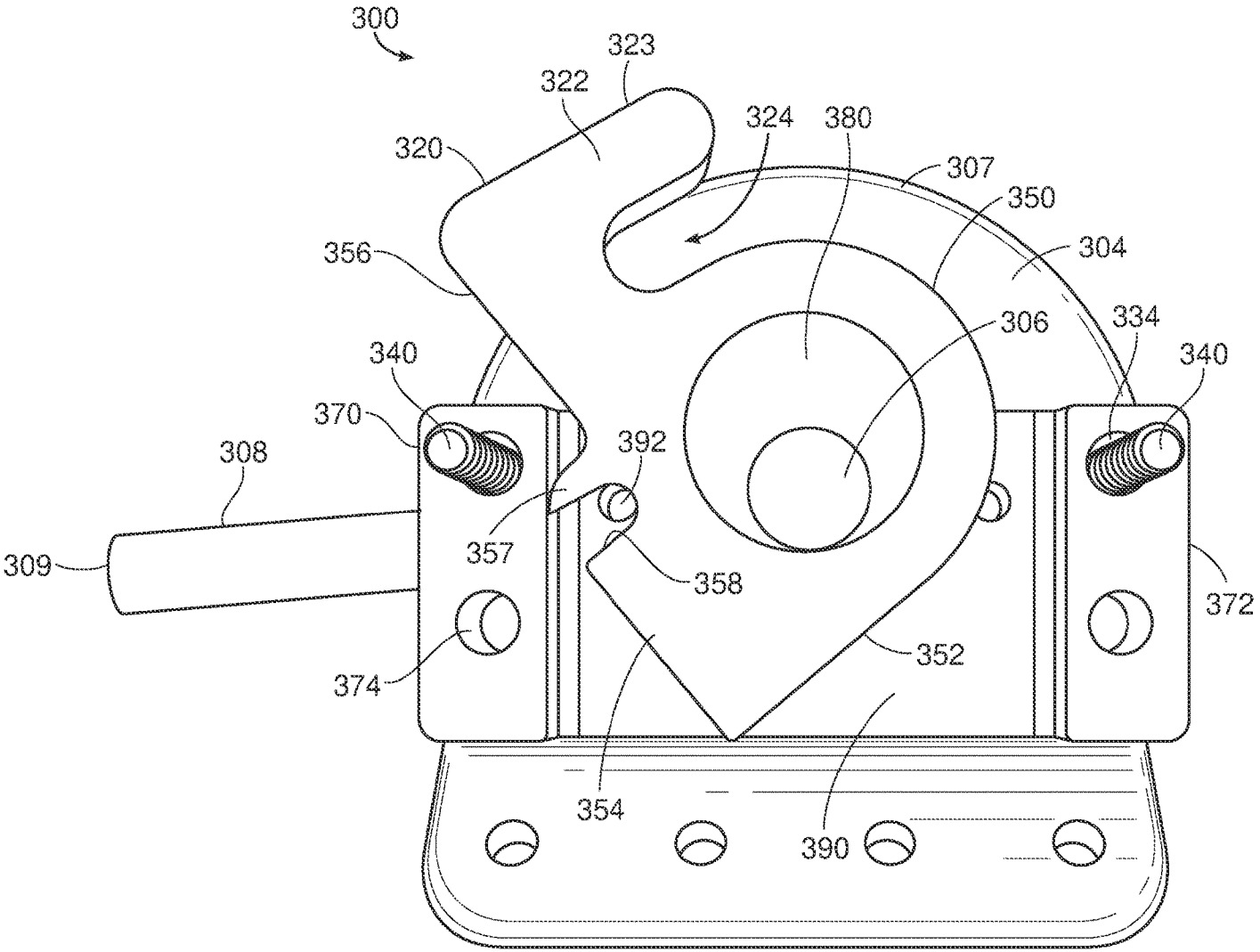
FIG. 11 is a perspective view of the rear side of the neck dam latch similar to the view of FIG. 5, except the cam latch support plate is not shown in order to facilitate viewing of the position of the cam latch.
Figure 12:
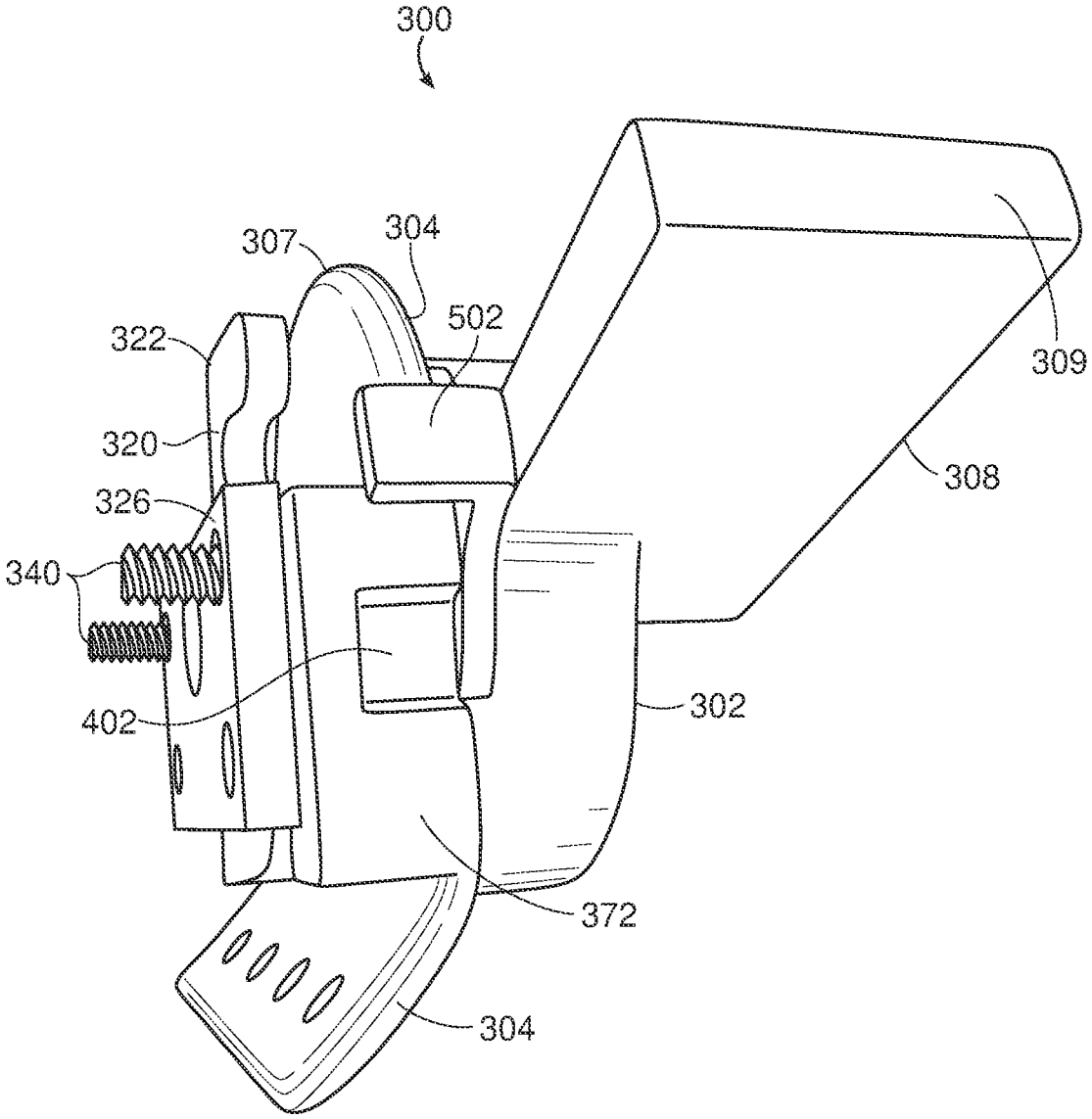
FIG. 12 is a perspective view of a first end of the neck dam latch device.
Figure 13:
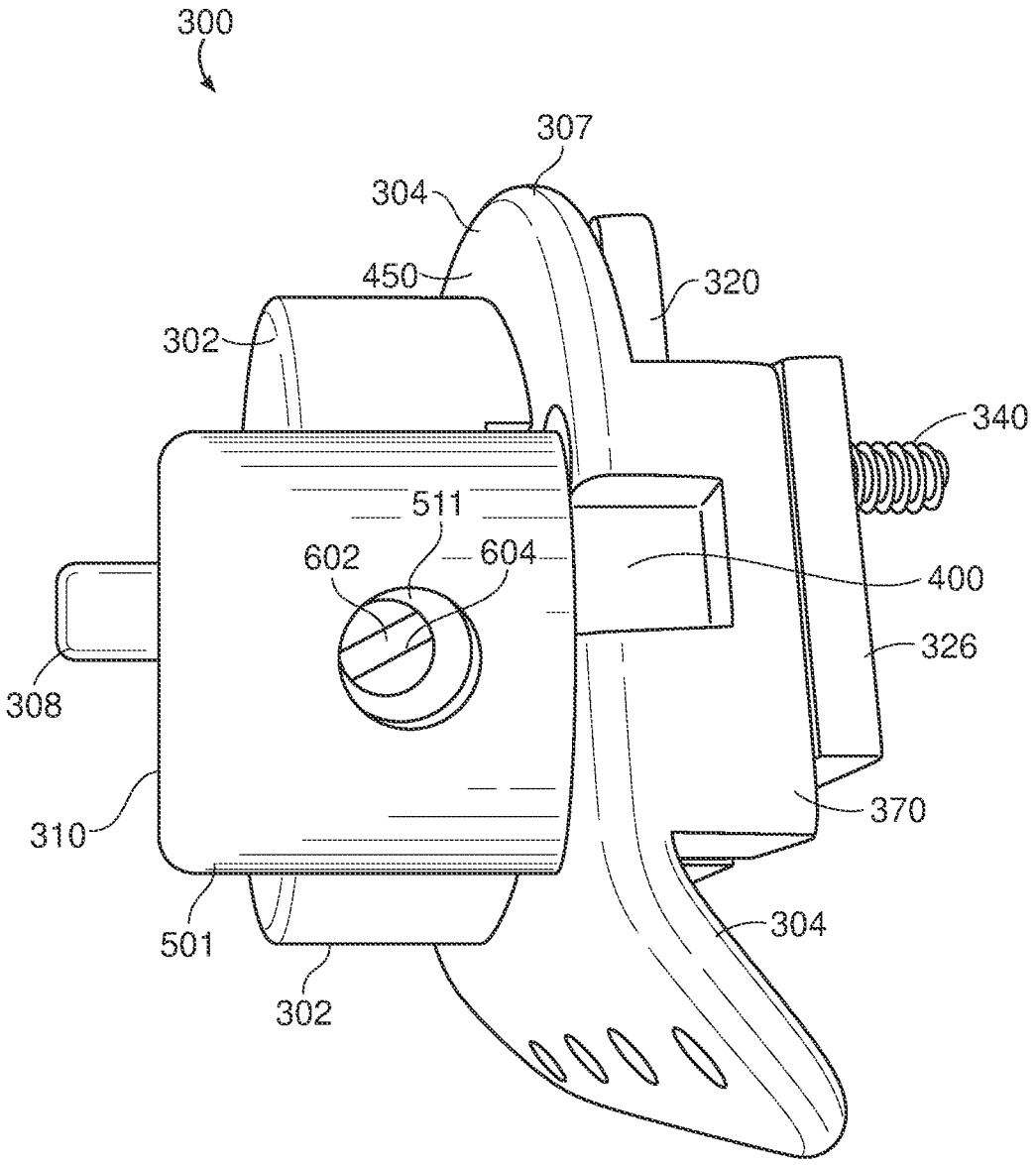
FIG. 13 is a perspective view of an opposite, second end of the neck dam latch device.

FIGS. 9 and 11 show the rear side of neck dam latch device 300 without cam latch support plate 326. FIG. 10 shows the rear side of neck dam latch device 300 without cam latch support plate 326 and cam latch 320. Neck dam latch device 300 further comprises a cam mechanism on the rear side of latch body 304 and attached to shaft member 306 such that the cam mechanism rotates with shaft member 306. The cam mechanism comprises offset cam member 380. The center of shaft member 306 defines the axis of rotation. As shown in FIG. 8, neck dam cam latch 320 further comprises curved section 350 that is contiguous with arm section 322. Cam latch 320 further includes straight edges 352, 354 and 356 and opening 360. Opening 360 is sized to receive offset cam member 380. Cam latch 320 further comprises lip portion 357 and notch 358 that is located between lip 357 and straight edge 354. As shown in FIGS. 9 and 11, cam latch 320 is mounted to the cam mechanism such that offset cam 380 is positioned within opening 360.

Referring to FIGS. 9-11, latch body 304 includes walls 370 and 372 which have through-holes 374 for receiving screws or fasteners 340. Latch body 304 includes substantially flat surface 390 upon which cam latch 320 and the cam mechanism pivot. Surface 390 extends between walls 370 and 372. Surface 390 includes recess or cavity 392 that is sized for receiving cam latch pin 332 of cam latch support plate 326 (see FIG. 7). Notch 358 of cam latch 320 is aligned with cavity 392. Cam latch pin 332 of cam latch support plate 326 fits through notch 358 and into cavity 392. FIG. 9 shows the position of cam latch 320 when latch casing 302 is completely rotated counter-clockwise 180° (when viewed in FIG. 3) to allow arm section 322 to grasp neck dam latch pin 250 on lower portion 260 of helmet 150. As shown in FIG. 9, cavity 392 is aligned with notch 358 and straight edge 354 abuts wall section 370 of latch body 304, and the entire offset cam 380 is located upon surface 390. FIG. 10 shows the position of offset cam 380 when latch casing 302 is rotated counter-clockwise 180°. Cam latch 320 is not shown in FIG. 10 in order to facilitate viewing of shaft member 306 and offset cam 380. FIG. 11 shows the position of cam latch 320 when latch casing 302 is completely rotated clockwise 180° (when viewed in FIG. 3) to allow cam latch 320 to release neck dam latch pin 250. The clockwise rotation of latch casing 302 results in offset cam 380 being pivoted upward such that a portion of offset cam 380 extends beyond surface 390 and arm section 322 of cam latch 320 extends beyond perimetrical edge 307 of latch body 304. As latch casing 302 rotates clockwise, cam latch 320 also rotates clockwise and edge 323 forcibly presses against lower portion 260 of helmet 150 (not shown in FIG. 11) thereby prying helmet 150 off of neck dam frame 204.

Figure 14B:
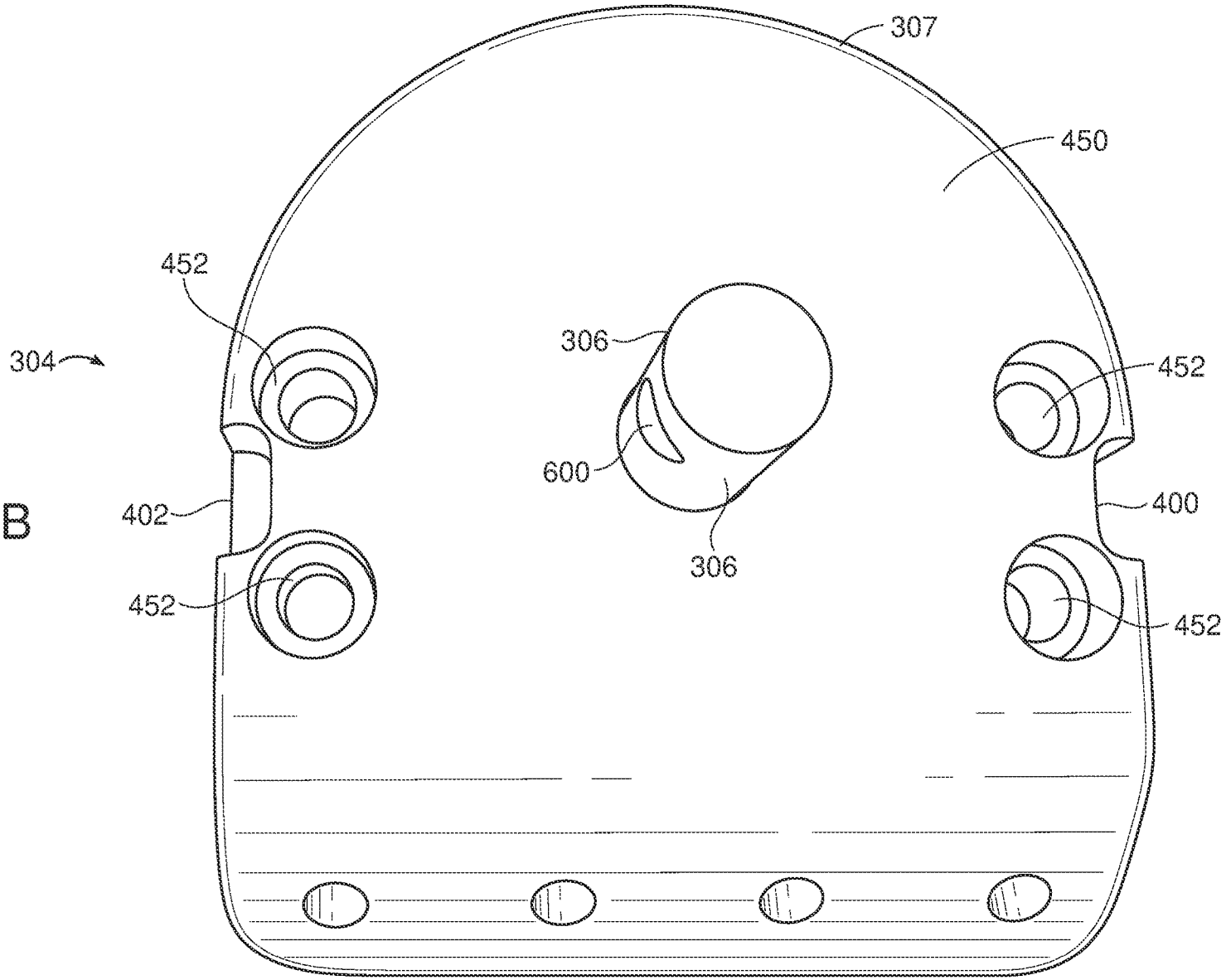
FIG. 14B is a perspective view of the front side of the latch body of the neck dam latch device.
Figure 16:
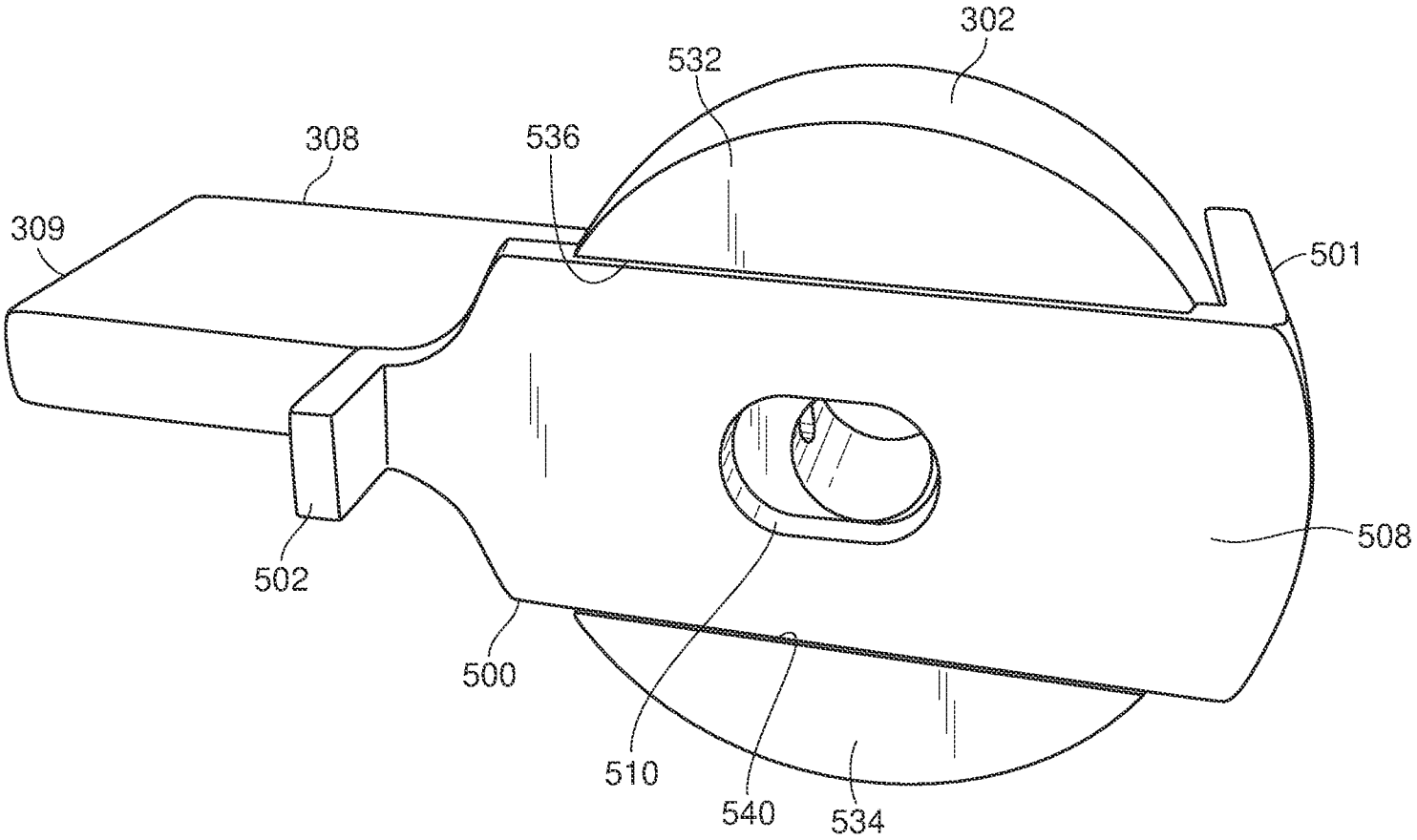
FIG. 16 is perspective view showing the arm member of FIG. 14A mounted to the rear side of the latch casing.

Referring to FIG. 14B, there is shown front side 450 of latch body 304. Thru-holes 452 are aligned with thru-holes 334 in cam latch support plate 326 and are sized for receiving screws or fasteners 340. Shaft member 306 is connected to the cam mechanism which is located on the rear side of latch body 304. Shaft member 306 includes bore or thru-hole 600 therein, the purpose of which is described in the ensuing description. Referring to FIGS. 14A and 16, arm member 500 of the latch release mechanism includes flange section 501, first side 506, opposite second side 508 and central through-hole 510. Flange section 501 includes through-hole 511, the purpose of which is described in the ensuing description. Arm member 500 includes projection 512 that upwardly extends from first side 506. In an exemplary embodiment, projection 512 is generally semi-circular in shape and has flat side 514 for contacting spring 516. Arm member 500 further includes projection 518 that upwardly extends from first side 506. In an exemplary embodiment, projection 518 is generally semi-circular in shape and has flat side 520 for contacting spring 522. As shown in FIG. 15, latch casing 302 further includes a rear or interior side having surface 530 that extends between wall sections 532 and 534. Wall section 532 has a straight portion 536 and curved portion 538. Curved portion 538 forms part of the exterior of latch casing 302. Similarly, wall section 534 has a straight portion 540 and a curved portion 542. Curved portion 542 also forms part of the exterior of latch casing 302. As shown in FIG. 14A, latch casing 302 includes channel 550 for receiving spring 516. Channel 550 has first end 551 and opposite second end 552. Projection 518 of arm section 500 is also sized to fit within and move through channel 550. Spring 516 has first end 560 and opposite second end 562. Channel 550 is sized so that when spring 516 is uncompressed and positioned in channel 550, the first end 560 of spring 516 is within channel 550 and positioned at end 551 and the second end 562 of spring 516 is outside of channel 550 and above end 552 of channel 550 (see FIG. 15). Thus, when spring 516 is uncompressed, it is longer than channel 550. Latch casing 302 further includes channel 554 for receiving spring 522. Channel 554 has first end 555 and opposite second end 556. Spring 522 has first end 570 and opposite second end 572. Channel 554 is sized so that when spring 522 is uncompressed and positioned in channel 554, the first end 570 of spring 522 is within channel 554 and positioned at end 555 and the second end 572 of spring 522 is outside of channel 554 and above end 556 of channel 554 (see FIG. 15). Thus, when spring 522 is uncompressed, it is longer than channel 554.

Referring to FIGS. 14A, 14B, 15 and 16, latch casing 302 further includes centrally located opening or thru-hole 590 that is sized to receive rotatable shaft member 306. As shown in FIG. 16, arm member 500 is positioned on surface 530 of latch casing 302 and located between straight sections 536 and 540 of wall sections 532 and 534, respectively, and is able to slide laterally. First side 506 of arm member 500 confronts surface 530 of latch casing 302. Although not visible in this view, projection 518 is positioned in channel 550 and spring member 516 is compressed between flat surface 520 of projection 518 and end 551 of channel 550. In such a configuration, end 562 of spring 516 abuts flat surface 520. Similarly, projection 512 is positioned in channel 554 and spring member 522 is compressed between flat surface 514 of projection 512 and end 555 of channel 554. In such a configuration, end 572 of spring member 522 abuts flat surface 514. Spring members 516 and 522 create a constant bias or force on arm member 500 that causes tab member 502 to be pulled into recesses 400 and 402 when latch casing 302 is rotated 180°. The assembly shown in FIG. 16 is then mounted to latch body 304 shown in FIG. 14B so that rotatable shaft member 306 is inserted through central opening 590 of latch casing 302 and central opening 510 of arm member 500, and side 508 of arm member 500 contacts surface 450 of latch body 304 (see FIGS. 3 and 14B). Since arm member 500 is positioned between straight portions 536 and 540 of wall sections 532 and 534, respectively, arm member 500 rotates clockwise or counterclockwise with latch casing 302.

Referring to FIG. 14B, shaft member 306 has a bore or passage 600 extending therethrough in a direction that is orthogonal to the longitudinally extending axis of shaft member 306. Latch casing 302 has a radially extending threaded bore that is accessible through opening 511 in flange portion 501 (see FIG. 13) and is configured to receive screw 602. Screw 602 is configured for threaded engagement with the radially extending threaded bore in latch casing 302 and includes slot 604. Slot 604 is sized to receive a straight edge of a tool such as a screw driver. The tool can be inserted through opening 511 in flange portion 501. When screw 602 is completely screwed into the radially extending threaded bore in latch casing 302, a portion of the screw 602 extends into bore 600 in shaft member 306 so that rotation of latch casing 302 will result in rotation of the cam mechanism located on the rear side of latch body 304.

In order to attach neck dam latch device 300 to neck dam frame 204, screws 340 are inserted through openings 452 in latch body 304 (see FIG. 14B) and through openings 334 in cam latch support plate 326 and then into threaded inlets or bores (not shown) in neck dam frame 204.

Figure 2C:
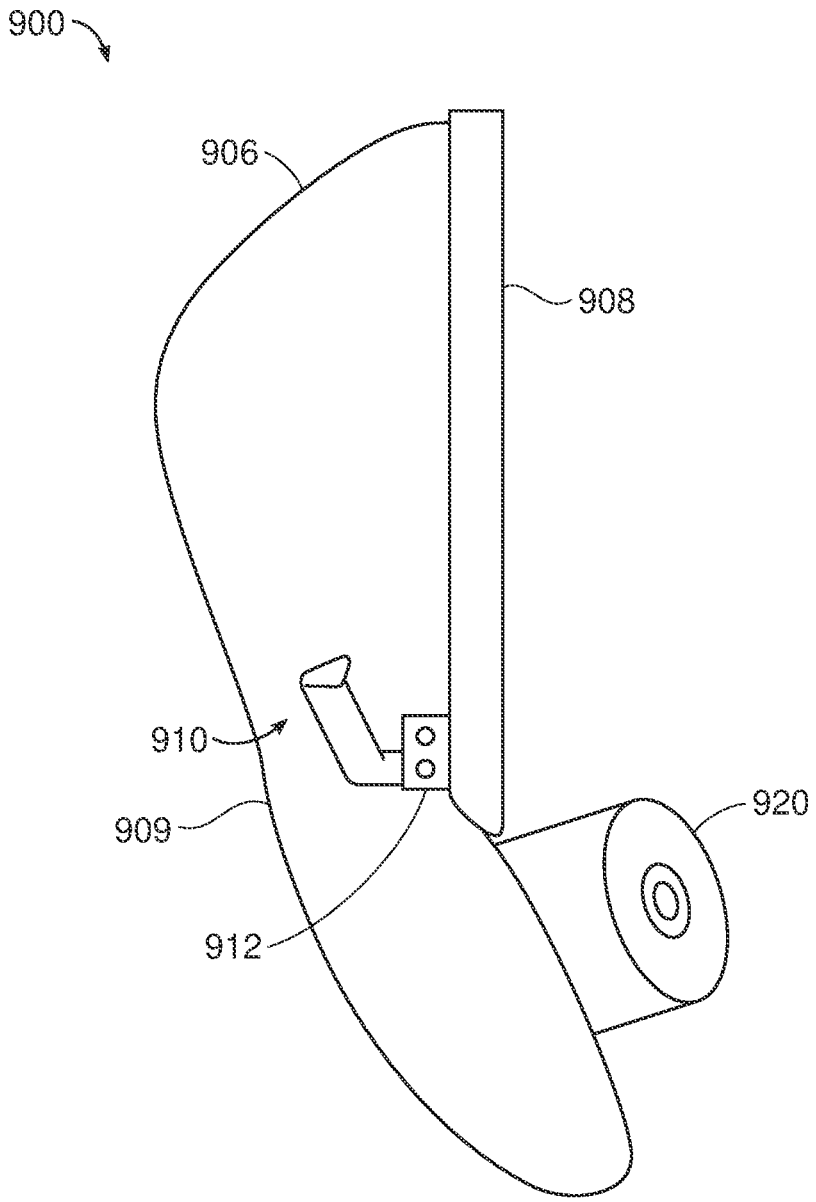
FIG. 2C is a side view, in perspective, of the face mask shown in FIG. 1B.

Referring to FIGS. 1B, 2B and 19-21, diving helmet apparatus 120 further comprises a pair of face mask latch devices, one of which being indicated by reference member 700. The other face mask latch device is located on the oppostie side of helmet 150 and is not shown. Since the face mask latch devices are identical, only face mask latch device 700 is described herein. Face mask latch device 700 is configured to secure face mask 900 to helmet 150 and to release face mask 900 from helmet 150. As shown in FIG. 2B, helmet 150 includes face mask seal 902 that extends about the perimeter of front opening 904 in helmet 150. When face mask 900 is secured to helmet 150, the face mask 900 is positioned on face mask seal 902 such that a water-tight seal is created which prevents water from entering the interior of helmet 150 through front opening 904. As shown in FIG. 2C, face mask 900 includes face mask frame 906 and face mask lens 908 that is attached to face mask frame 906. In an exemplary embodiment, face mask frame 906 is fabricated from fiberglass and face mask lens 908 is fabricated from glass. Face mask frame 906 includes substantially flat sealing surface 909 that extends along the rear edge of face mask frame 906. Face mask 900 further includes a pair of face mask latch pins that are attached to face mask frame 906. One of the face mask latch pins is indicated by reference number 910 and is shown in FIG. 2C. The other face mask latch pin is on the opposite side of face mask 900 and is therefore not shown in FIG. 2C. Each face mask latch pin is attached to face mask frame 906 with a corresponding bracket 912. The diver uses face mask latch device 700 to pull face mask 900 towards helmet 150 so that face mask 900 is forcibly pressed against face mask seal 902 thereby creating a water-tight seal. In order to accomplish this, the diver adjusts face mask latch device 700 so as to grasp and retain face mask latch pin 910 in order to pull face mask 900 firmly against face mask seal 902. The diver also uses face mask latch device 700 to release face mask 900 from face mask seal 902. In order to accomplish this, the diver adjusts face mask latch device 700 to release face mask latch pin 910 so as to release face mask 900 from face mask seal 902. Face mask 900 further comprises open circuit regulator 920 and a switch-over valve (not shown) that allows a diver to switch from breathing open circuit SCUBA to a closed circuit rebreather.

In an alternate embodiment, face mask seal 902 is not used. Instead, the rear peripheral edge of face mask 900 includes a seal (not shown) that contacts the peripheral edge of front opening 904 to create a water-tight seal when face mask 900 is secured to helmet 150.

Figure 17:
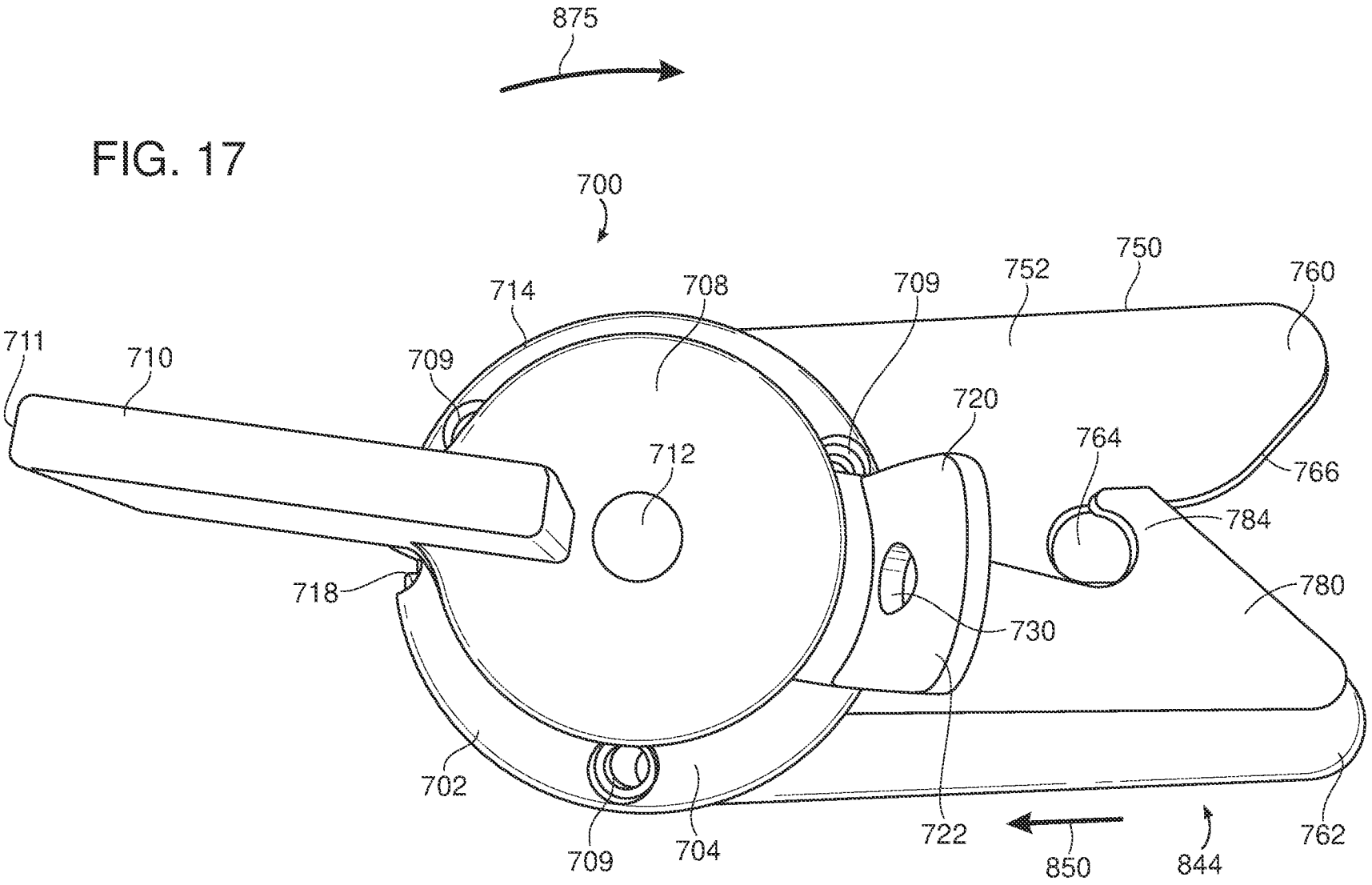
FIG. 17 is a perspective view of the front side of a face mask latch device shown in FIG. 1B, wherein the face mask latch device is configured to secure the face mask to the helmet.
Figure 18:
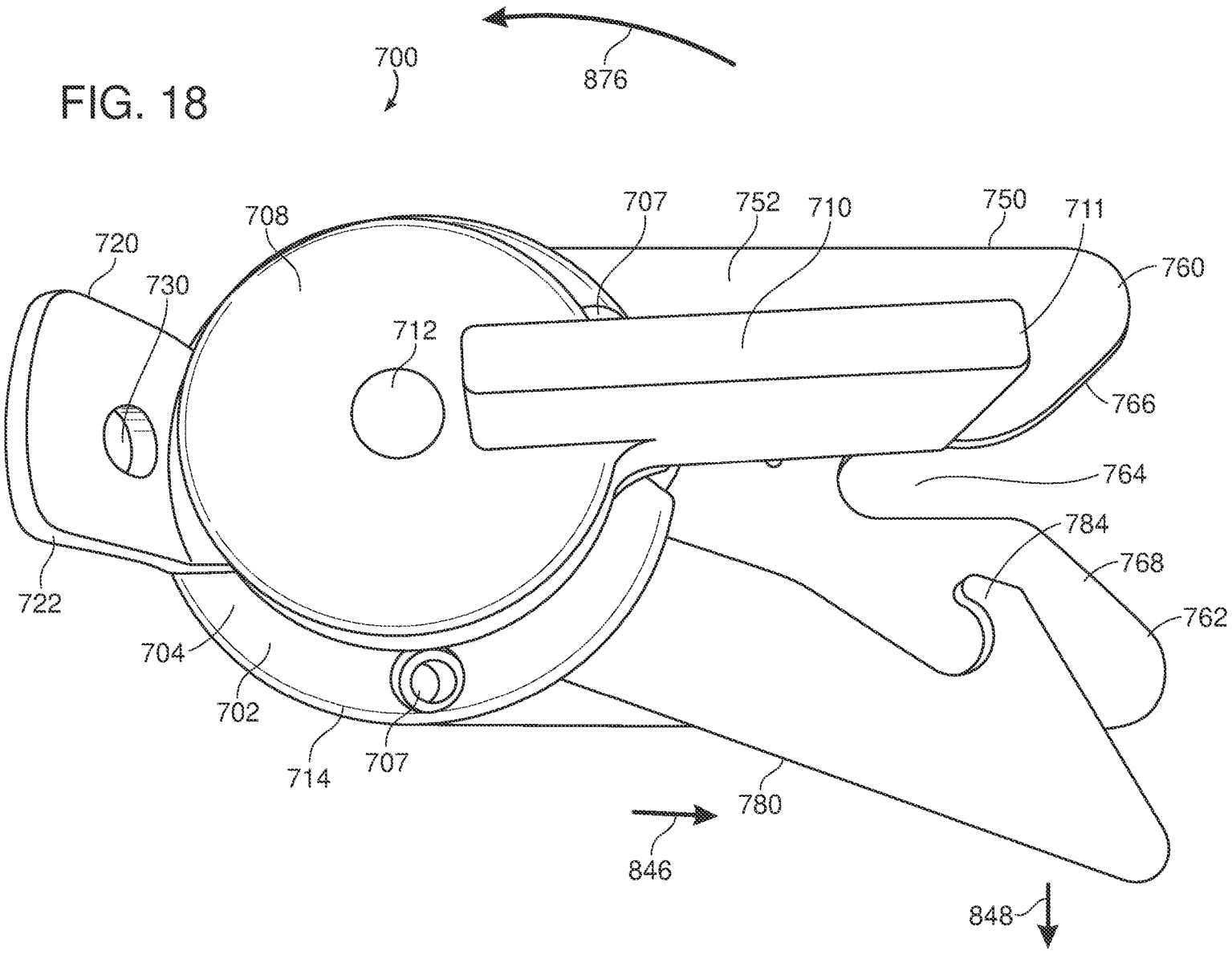
FIG. 18 is another perspective view of the front side of the face mask latch device, wherein the face mask latch device is now configured to release the face mask from the helmet.
Figure 19:
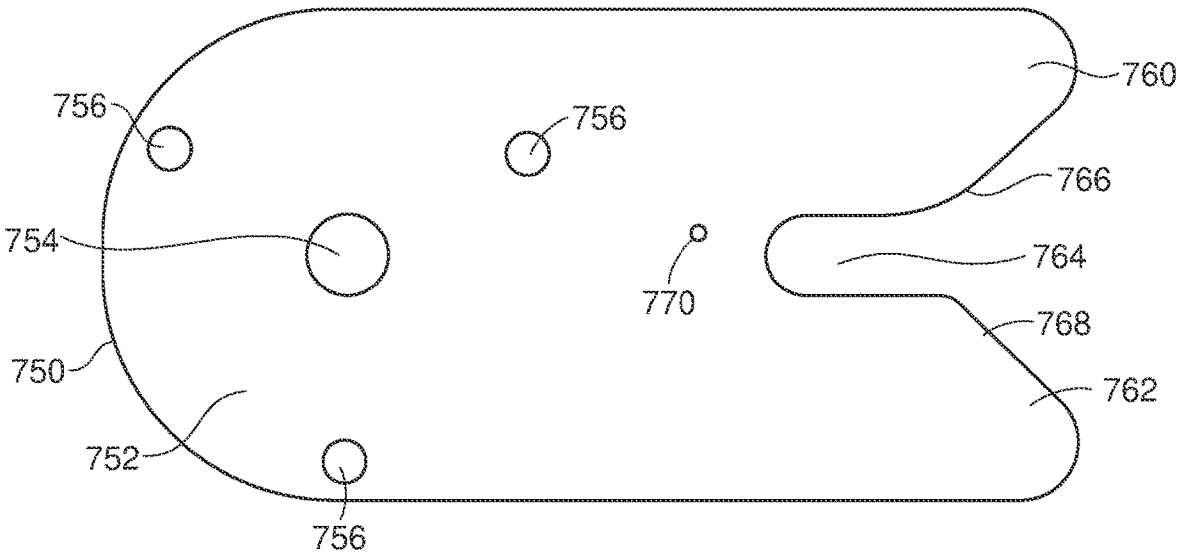
FIG. 19 is a front elevational view of a latch plate shown in FIGS. 17 and 18.
Figure 20:
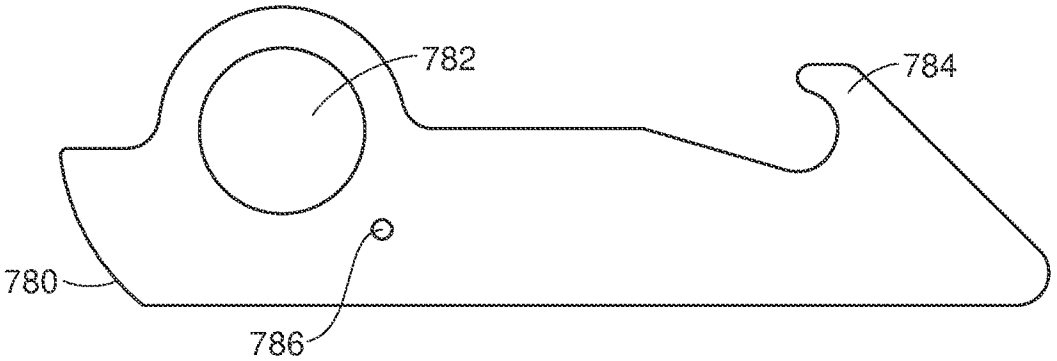
FIG. 20 is a front elevational view of a latch shown in FIGS. 17 and 18.
Figure 21:
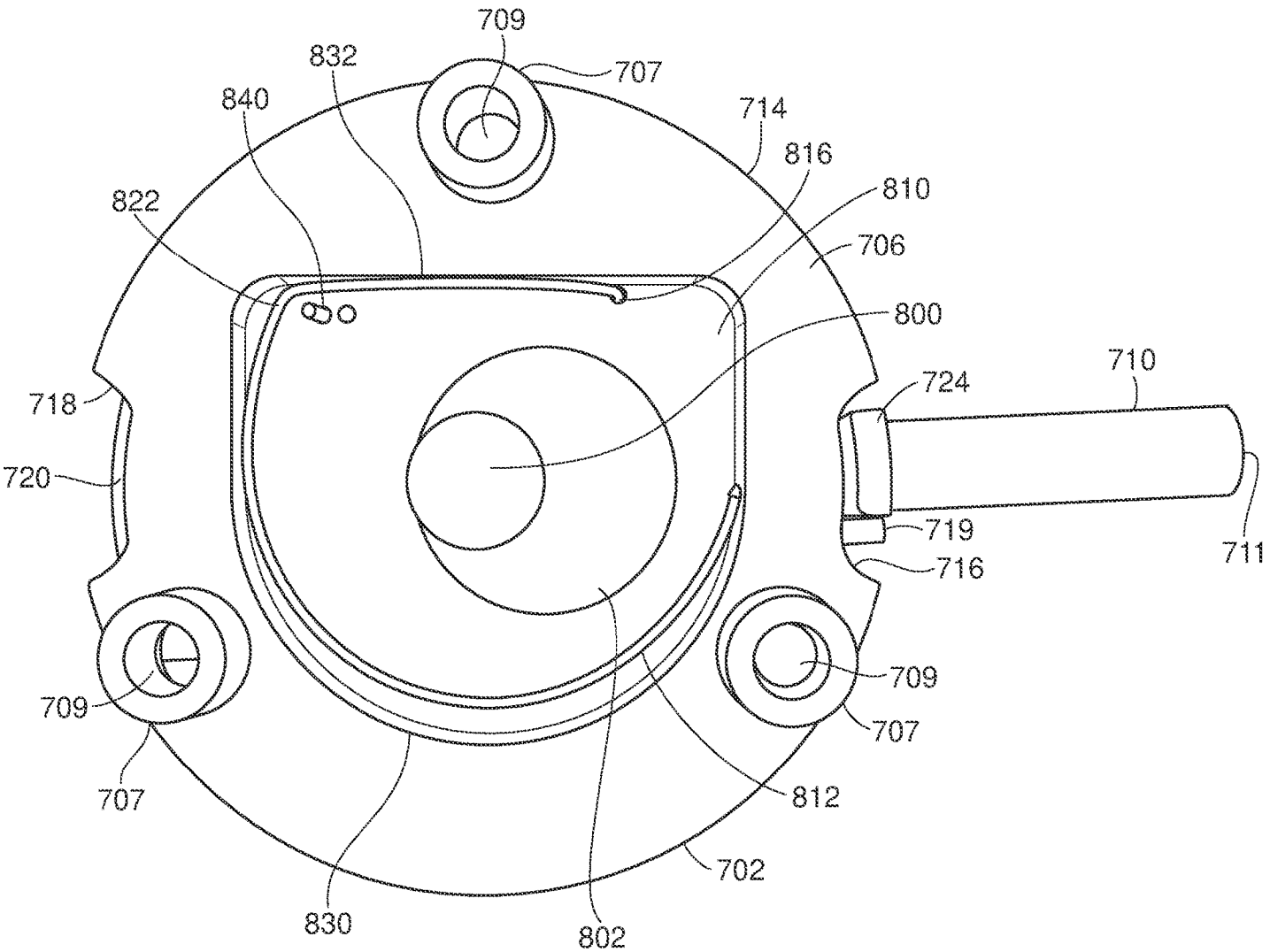
FIG. 21 is a rear elevational view of a latch body shown in FIGS. 17 and 18, the view also showing a cam mechanism adapted to move the latch.
Figure 23:
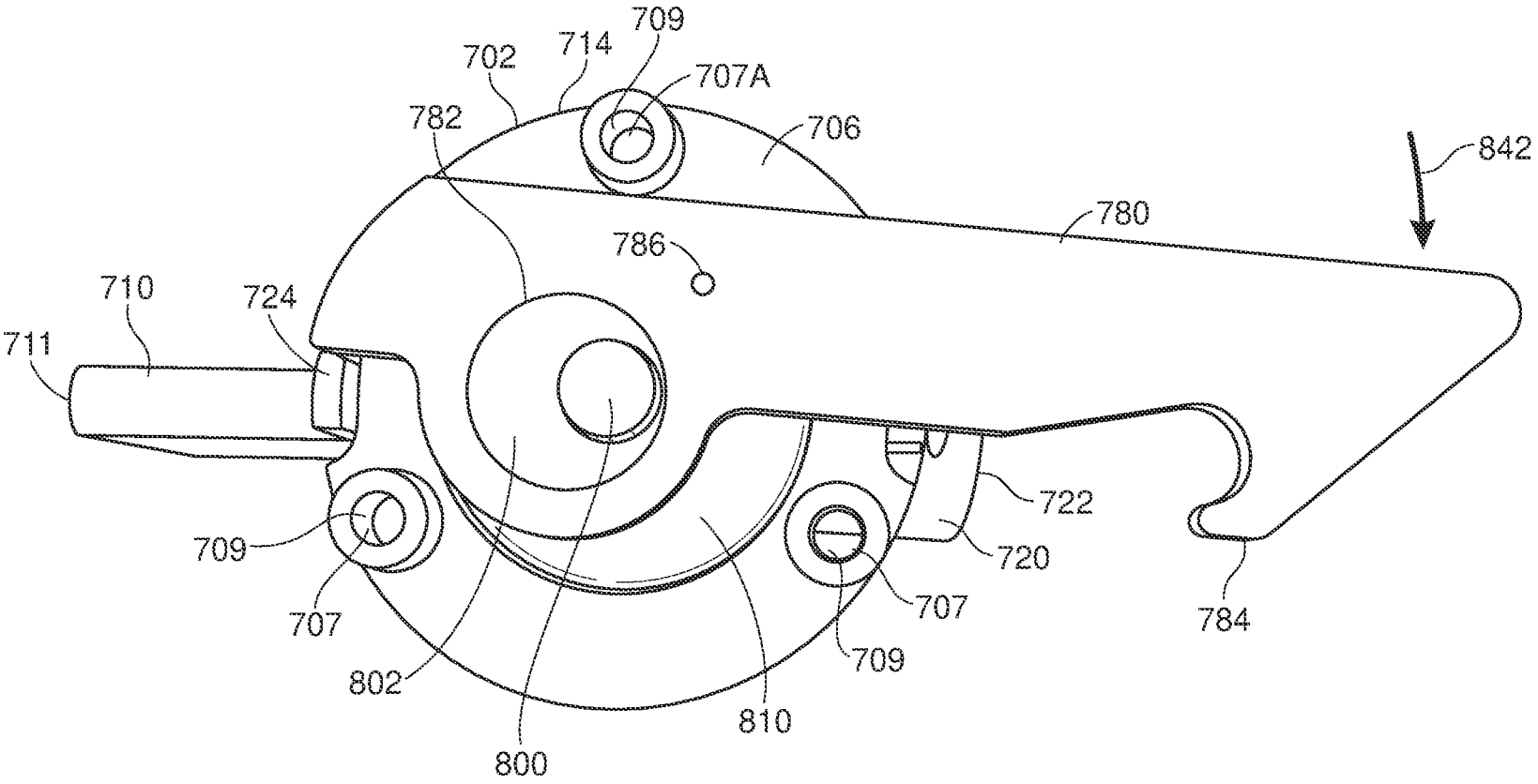
FIG. 23 is a rear elevational view of the face mask latch device without the latch plate in order to facilitate viewing of the latch mounted on the cam mechanism.

Referring to FIGS. 17, 18, and 21, face mask latch device 700 comprises face mask latch body 702 which has front side 704 and rear side 706 (see FIG. 23). Face mask latch body 702 further includes spacer structures 707 that have corresponding thru-holes or openings 709 that receive screws or fasteners (not shown) for attaching face mask latch device 700 to helmet 150. Face mask latch device 700 further comprises face mask latch casing 708 which is rotatably attached to face mask latch body 702 and located on front side 704. Latch casing 708 has the same structure as latch casing 302 described in the foregoing description. Latch casing 708 includes handle 710 which extends to distal end 711. The diver uses handle 710 to rotate latch casing 708 clockwise or counter-clockwise. Latch casing 708 includes central bore that is sized for receiving rotatable face mask shaft member 712. Face mask shaft member 712 is identical in structure to neck dam shaft member 306 (see FIG. 14B). Shaft member 712 is part of a cam mechanism that is on the rear side of latch body 702 and which is identical to the cam mechanism of neck dam latch device 300. The cam mechanism of face mask latch device 700 is described in detail in the ensuing description. Latch body 702 has a peripheral portion 714 and a pair of recesses or notches 716 and 718 formed in peripheral portion 714. Notches 716 and 718 have the same function as notches 400 and 402 shown in FIGS. 12 and 13. Latch body 702 includes pin 719 located within notch 716. The purpose of pin 719 is described in the ensuing description. Face mask latch device 700 further comprises a latch release mechanism which includes arm member 720. Arm member 720 has an identical structure, shape and function as arm structure 500 shown in FIG. 14A. Arm member 720 includes flange member 722 and tab member 724. Flange member 722 and tab member 724 have the same structure and function as flange member 501 and tab member 502, respectively, shown in FIGS. 14A and 16. Tab member 724 is sized to fit into notches 716 and 718. The latch release mechanism of face mask latch device 700 operates in the same manner as the latch release mechanism of neck dam latch device 300 and includes spring members (not shown) that function in the same manner as spring members 516 and 522 (see FIG. 14A) and are configured to fit into corresponding channels (not shown) that are formed in the rear of latch casing 708. The channels formed in the rear side of latch casing 708 have the same shape and size as channels 550 and 554 shown in FIG. 14A. The structure, operation and function of the latch release mechanism of face mask latch device 700 are identical to that of the latch release mechanism of neck dam latch device 300 and therefore is not discussed in detail herein.

Referring to FIGS. 17 and 18, flange member 722 has thru-hole or opening 730 which performs the same function as thru-hole 511 in flange member 501 (see FIGS. 3 and 14A). Face mask latch device 700 further includes screw or fastener (not shown) that is accessible through opening 730 and is disposed within a threaded bore (not shown) in latch casing 708 and connects latch casing 708 to shaft member 712. This aforesaid screw that connects latch casing 708 to shaft member 712 has the same structure and function as that of screw 602 (see FIG. 13). As a result of such a configuration, shaft member 712 rotates with latch casing 708.

Referring to FIGS. 17-20, face mask latch device 700 further includes latch plate 750. Latch plate 750 includes front side 752 and an opposite rear side (not shown). Latch plate 750 has central opening 754, the purpose of which is described in the ensuing description. Latch plate 750 includes thru-holes 756 that are aligned with openings 709 in latch body 702 and sized to receive screws or other fasteners (not shown) that attach or connect face mask latch device 700 to helmet 150. When face mask latch device 700 is attached to helmet 150, latch plate 750 abuts helmet 150. Latch plate 750 further includes section 760 and section 762. Gap or space 764 separates section 760 and section 762 and is sized to receive face mask latch pin 910. Section 760 has angulated edge 766. Similarly, section 762 has an angulated edge 768. Angulated edges 766 and 768 facilitate movement of face mask latch pin 910 into gap 764 when a user wants to secure face mask 900 to helmet 150 and create a water-tight seal. Latch plate 750 further includes pin 770 that extends upward from front side 752. The purpose of pin 770 is described in the ensuing description.

Face mask latch device 700 further includes latch 780 that is movable with respect to latch plate 750. Latch 780 has opening 782, the purpose of which is discussed in the ensuing description. Latch 780 includes hook portion 784 that is configured and sized to grasp face mask latch pin 910. Latch 780 includes thru-hole 786, the purpose of which is described in the ensuing description.

Figure 22:
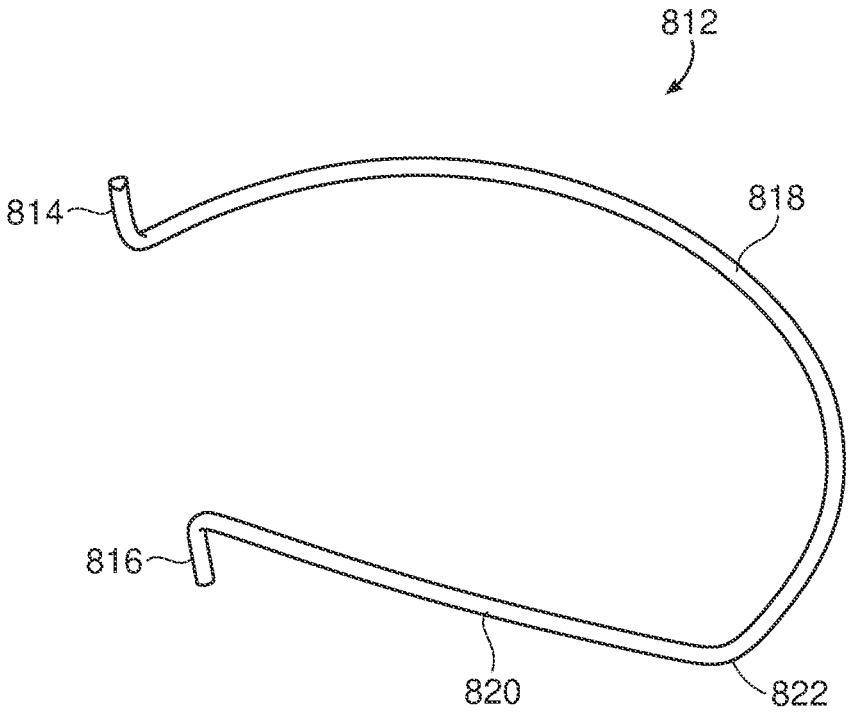
FIG. 22 is a perspective view of a tension spring shown in FIG. 21.

Referring also to FIG. 21, there is shown rear side 706 of latch body 702. Rotatable shaft member 712 extends through latch body 702 and has end portion 800. Latch body 702 includes a cam mechanism that comprises end portion 800 of rotatable shaft member 712 and offset cam 802 which is attached to end portion 800. Shaft member 712 defines the axis of rotation of the cam mechanism. This cam mechanism is identical to the cam mechanism of neck dam latch device 300. Opening 782 of latch 780 receives offset cam 802 as shown in FIG. 23. Opening 754 of latch plate 750 receives end portion 800 of rotatable shaft member 712. As shown in FIG. 21, latch body 702 includes recess area 810 within which the cam mechanism pivots or rotates clockwise or counter-clockwise. Tension spring 812 is positioned within recess 810. As shown in FIG. 22, tension spring 812 has front end 814 that extends upward, a second end 816 that extends downward, curved section 818, straight section 820 and corner section 822. As shown in FIG. 21, recess 810 has a curved edge 830 and straight edge 832. Latch body 702 further includes upwardly extending tension spring support pin 840 that is located within recess 810. As shown in FIG. 21, tension spring 812 is positioned within recess 810 such that second end 816 is disposed within a corresponding cavity in recess 810 and corner portion 822 is on the outside of tension spring support pin 840. First end 814 of tension spring 812 is sized to fit into thru-hole 786 of latch 780 (see FIG. 23). In FIG. 23, the view of tension spring 812 is obscured by latch 780. Tension spring 812 urges latch 780 in the direction indicated by arrow 842. When face mask latch device 700 is oriented as shown in FIGS. 17 and 18, the direction indicated by arrow 842 translates to the direction indicated by arrow 844 shown in FIG. 17. Therefore, looking at FIG. 17, tension spring 812 urges latch 780 upward in the direction indicated by arrow 844.

Referring still to FIG. 17, there is shown face mask latch device 700 in a first state wherein latch 780 is positioned so that hook portion 784 will grasp face mask latch pin 910 and retain it within gap 764. In this first state, tab 724 of arm member 720 is completely positioned within notch 718 such that latch casing 708 is locked in place and hook portion 784 firmly grasps face mask latch pin 910 and holds it within gap 764. In this state, latch 780 cannot move in any direction and is locked in place. In order to release face mask 900 from helmet 150, the diver uses his or her fingers (e.g. thumb and index finger) to grasp distal end 711 of handle 710 and flange member 722. The diver then depresses flange member 722 radially with respect to end portion 800 of shaft member 712 in order to displace tab 724 from notch 718. The force applied by the diver's fingers must overcome the opposite force produced by the internal springs (not shown) of the latch release mechanism. Once tab 724 is displaced from notch 718, the user then rotates latch casing 708 clockwise 180° in accordance with directional arrow 875 in FIG. 17. As latch casing 708 is rotating clockwise, tab 724 is riding or sliding upon periphery 714 of latch body 702. As latch casing 708 rotates clockwise, the cam mechanism causes latch 780 to move outward in the direction indicated by arrow 846 and downward in the direction indicated by arrow 848 (see FIG. 18) so as to allow hook portion 784 to disengage from face mask latch pin 910 and to allow face mask latch pin 910 to be withdrawn from gap 764. When latch casing 708 rotates clockwise 180°, the internal springs (not shown) of the latch release mechanism pull tab member 724 into notch 716. Once tab member 724 is completely positioned in notch 716 and contacts pin 719, latch 780 does not move further outward (i.e. direction 846) or downward (i.e. direction 848). Latch 780 is prevented from further downward movement by spacer 707A. Although tension spring 812 urges latch 780 upward, tab member 724 prevents any upward movement of latch 780. In order to once again secure face mask 900 to helmet 150, the diver first maneuvers face mask 900 so that face mask latch pin 910 is positioned within gap 764. Next, the diver user uses his or her fingers (e.g. thumb and index finger) to grasp distal end 711 of handle 710 and flange member 722 and then depresses flange member 722 radially in order to displace tab member 724 from notch 716. Once tab member 724 is displaced from notch 716, the user rotates latch casing 708 counter-clockwise as indicted by arrow 876 in FIG. 18 so that tab member 724 rides along perimeter 714 of latch casing 708. Once tab member 724 is displaced from notch 716, the force created by tension spring 812 pulls latch 780 upward in the direction indicated by arrow 844 shown in FIG. 17. As the diver rotates latch casing 708 counter-clockwise, the cam mechanism causes latch 780 to move in a direction indicated by arrow 850 in FIG. 17 so that hook portion 784 of latch 780 grasps face mask latch pin 910 and pulls face mask 900 against face mask seal 902 (see FIG. 2B) so as to secure face mask 900 to helmet 150 with a high-integrity, water-tight connection. The function of pin member 770 on front side 752 of latch plate 750 limits the upward movement of latch 780.

Referring to FIG. 2B, when the diver is placing helmet 150 on his or her head, the diver's face must be secured to the oral nasal mask located within the helmet interior so as to insure exhaled gas does not escape into the interior region of helmet 150. In order to ensure that the diver's face is secured to the oral nasal mask, helmet 150 includes harness 1000 that is located within the interior region of helmet 150. Harness 1000 is located in the rear area of the interior region of helmet 150 such that harness 1000 is located behind the diver's head. In an exemplary embodiment, harness 1000 is triangular in shape and is fabricated from 1.5 inch wide straps that are suitable for use in hyperbaric environments. Top portion 1002 of harness 1000 is secured to the upper portion of the rear interior wall 1004 of helmet 150. In an exemplary embodiment, fastener 1006 is used to attach top portion 1002 of harness 1000 to rear interior wall 1004. As a result of this configuration, harness 1000 physically contacts the back of the diver's head. Harness 1000 can be adjusted or moved by turning take-up knob 1020. Cable 1022 (shown in phantom) is connected to take-up knob 1020 on the side of helmet 150. Cable 1022 extends through the lower portion 1024 of harness 1000 and to the other side of helmet 150 where it is secured to helmet 150 via cable attachment device 1026. In an exemplary embodiment, cable 1022 has a diameter of about ⅛ inch. As take-up knob 1020 is rotated clockwise, the lower portion 1024 of harness 1000 moves forward so as to push the diver's head into the oral nasal mask. In order to release the harness pressure, the diver turns the take-up knob 1020 counter-clockwise.

The shape and configuration of helmet 150 is based on the $98^{th}$ percentile anthropomorphic head form 100 (see FIG. 1A) thereby resulting in a helmet that is significantly smaller and lighter than convention diving helmets. Helmet 150 is configured so that the CG and CB are in the center of helmet 150 thereby allowing the diver to easily engage in free-swimming and also reducing diver fatigue. The unique neck dam latch devices 300 and 675 use cam mechanisms that allow the diver to easily attach helmet 150 to substantially oval-shaped neck dam 200 and to easily release helmet 150 from neck dam 200. The diver does not need tenders in order to don and doff helmet 150. The substantially oval-shaped neck dam contributes to the substantial reduction of the volume of helmet 150. The unique face mask latch devices (e.g. face mask latch device 700) allows the diver to easily secure face mask 900 to helmet 150.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A helmet, comprising:

an exterior surface;

an interior region for a user's head;

an interior wall within the interior region;

a substantially oval-shaped head-entry opening leading to the interior region;

a substantially oval-shaped neck dam mating surface extending about the substantially oval-shaped head-entry opening;

a front opening;

a face mask seal extending about the front opening;

a face mask removably secured to the face mask seal so as to create a water-tight seal, wherein the face mask comprises a frame, a lens attached to the frame and a pair of face mask latch pins attached to the frame; and a pair of face mask latch devices attached to the exterior surface of the helmet, wherein each face mask latch device is associated with a corresponding one of the pair of face mask latch pins and wherein each face mask latch device is configurable to a first position to engage the face mask latch pin so as to secure the face mask to the face mask seal and to a second position to disengage the face mask latch pin so as to release the face mask from the face mask seal;

wherein each face mask latch device comprises:

a face mask latch body attached to the helmet proximate to a corresponding face mask latch pin;

a face mask latch casing rotatably coupled to the face mask latch body and having a handle extending therefrom;

a face mask latch disposed between the face mask latch casing and the helmet, said face mask latch having an opening therein and a hook portion configured to grasp the corresponding face mask latch pin; and a rotatable face mask latch shaft member fixedly attached to the face mask latch casing, said face mask latch shaft member having an offset cam attached to an end thereof, wherein the offset cam is inserted into the opening in the face match latch;

whereby rotation of the face mask latch casing in a first direction causes the hook portion of the face mask latch to move outward away from the face mask latch shaft member and rotate away from the face mask latch pin, thereby releasing the face mask latch pin; and whereby rotation of the face mask latch casing in a second direction causes the hook portion of the face mask latch to rotate toward the face mask latch pin and move inward toward the shaft member to grasp the face mask latch pin.

2. The helmet according to claim 1 wherein the frame of the face mask has a first end and an opposite second end and wherein one of the face mask latch pins is attached to the first end of the frame and the other face mask latch pin is attached to the opposite second end.

3. The helmet according to claim 2 further comprising a pair of neck dam latch pins, wherein one neck dam latch pin is attached to the exterior surface of the helmet and located on a first side of the helmet and the other neck dam latch pin is attached to the exterior surface of the helmet and located on an opposite second side of the helmet.

4. A helmet, comprising:

an exterior surface;

an interior region for a user's head;

an interior wall within the interior region;

a substantially oval-shaped head-entry opening leading to the interior region;

a substantially oval-shaped neck dam mating surface extending about the substantially oval-shaped head-entry opening;

an oral nasal mask located within the interior region; and an adjustable device configured to maintain a user's mouth and nose within the oral nasal mask, wherein the adjustable device comprises:

a harness having an upper portion attached to the interior wall of the helmet and a lower portion;

a cable secured to the lower portion; and a rotatable member attached to the exterior surface of the helmet and engaged with the cable, wherein rotation in a first direction moves the harness forward so as to maintain the user's mouth and nose within the oral nasal mask and in a second direction that moves the harness backward.

5. The helmet according to claim 4 wherein the harness has a triangular geometric shape having an apex that defines the upper portion of the harness and a base that defines the lower portion of the harness.

6. A helmet apparatus, comprising:

a helmet having an exterior surface, an interior region for a user's head, an interior wall within the interior region, a substantially oval-shaped head-entry opening leading to the interior region, and a substantially oval-shaped neck dam mating surface extending about the substantially oval-shaped head-entry opening, the helmet further comprising a pair of neck dam latch pins, wherein one of the neck dam latch pins is attached to the exterior surface of the helmet and located on a first side of the helmet and the other neck dam latch pin is attached to the exterior surface of the helmet and located on an opposite second side of the helmet;

a neck dam comprising a neck dam frame having a substantially oval shape that corresponds to the substantially oval shape of the neck dam mating surface, wherein the neck dam frame has a surface adapted to be joined to the substantially oval-shaped mating surface of the helmet; and a pair of neck dam latch devices attached to the neck dam frame, wherein each neck dam latch device is associated with a corresponding one of the pair of neck dam latch pins, wherein each neck dam latch device is configurable to a first position to engage the neck dam latch pin so as to secure the neck dam mating surface of the helmet to the surface of the neck dam frame and to a second position to disengage the neck dam latch pin so as to release the neck dam mating surface from the surface of the neck dam frame;

wherein each neck dam latch device comprises:

a neck dam latch body attached to the helmet proximate to a corresponding neck dam latch pin;

a neck dam latch casing rotatably coupled to the neck dam latch body and having a handle extending therefrom;

a rotatable neck dam latch shaft member fixedly attached to the neck dam latch casing, said neck dam latch shaft member having an offset cam on an end thereof; and a neck dam cam latch having an opening therein and a hook portion configured to grasp the corresponding neck dam latch pin, wherein the offset cam of the neck dam latch shaft member is inserted into the opening in the neck dam cam latch;

whereby rotation of the neck dam latch casing in a first direction causes the hook portion of the neck dam cam latch to move outward away from the neck dam latch shaft member and rotate away from the neck dam latch pin, thereby releasing the neck dam latch pin; and whereby rotation of the neck dam latch casing in a second direction causes the hook portion of the neck dam cam latch to rotate toward the neck dam latch pin and move inward toward the neck dam shaft member to grasp the neck dam latch pin.

7. The helmet apparatus according to claim 6 wherein the helmet further comprises a front opening, a face mask seal extending about the front opening and a face mask removably secured to the face mask seal, wherein the face mask comprises a frame, a lens attached to the frame and a pair of face mask latch pins attached to the frame.

8. The helmet apparatus according to claim 7 further comprising a pair of face mask latch devices attached to the exterior surface of the helmet, wherein each face mask latch device is associated with a corresponding one of the pair of face mask latch pins and wherein each face mask latch device is configurable to a first position to engage the face mask latch pin so as to secure the face mask to the face mask seal and to a second position to disengage the face mask latch pin so as to release the face mask from the face mask seal.

9. The helmet apparatus according to claim 8, wherein each face mask latch device comprises:

a face mask latch body attached to the helmet proximate to a corresponding face mask latch pin;

a face mask latch casing rotatably coupled to the face mask latch body and having a handle extending therefrom;

a face mask latch disposed between the face mask latch casing and the helmet, said face mask latch having an opening therein and a hook portion configured to grasp the corresponding face mask latch pin; and a rotatable face mask latch shaft member fixedly attached to the face mask latch casing, said face mask latch shaft member having an offset cam attached to an end thereof, wherein the offset cam is inserted into the opening in the face match latch;

whereby rotation of the face mask latch casing in a first direction causes the hook portion of the face mask latch to move outward away from the face mask latch shaft member and rotate away from the face mask latch pin, thereby releasing the face mask latch pin; and whereby rotation of the face mask latch casing in a second direction causes the hook portion of the face mask latch to rotate toward the face mask latch pin and move inward toward the shaft member to grasp the face mask latch pin.

10. The helmet apparatus according to claim 9 further comprising:

an oral nasal mask located within the interior region; and an adjustable device to maintain a user's mouth and nose within the oral nasal mask.

11. The helmet apparatus according to claim 10 wherein the adjustable device comprises:

a harness having an upper portion attached to the interior wall of the helmet and a lower portion;

a cable secured to the lower portion; and a rotatable member engaged with the cable wherein rotation in a first direction moves the harness forward so as to maintain the user's head within the oral nasal mask and in a second direction that moves the harness backward.

12. The helmet apparatus according to claim 11 wherein the harness has a triangular geometric shape having an apex that defines the upper portion of the harness and a base that defines the lower portion of the harness.

* * * * *